US006667097B2

(12) United States Patent
Tokarsky et al.

(10) Patent No.: US 6,667,097 B2
(45) Date of Patent: Dec. 23, 2003

(54) HIGH SPEED MELT SPINNING OF FLUOROPOLYMER FIBERS

(76) Inventors: Edward William Tokarsky, 3 The Horseshoe, Newark, DE (US) 19711; William Cheng Uy, 621 Parkridge Dr., Hockessin, DE (US) 19707

( * ) Notice: Subject to any disclaimer, the term of this patent is extended or adjusted under 35 U.S.C. 154(b) by 0 days.

(21) Appl. No.: 10/238,808

(22) Filed: Sep. 10, 2002

(65) Prior Publication Data

US 2003/0175513 A1 Sep. 18, 2003

Related U.S. Application Data

(63) Continuation-in-part of application No. 09/920,701, filed on Aug. 2, 2001, which is a continuation-in-part of application No. 09/857,573, filed as application No. PCT/US00/02108 on Jan. 28, 2000, now abandoned.

(60) Provisional application No. 60/117,831, filed on Jan. 29, 1999, now abandoned, and provisional application No. 60/109,631, filed on Dec. 8, 1999, now abandoned.

(51) Int. Cl.[7] ..... D01F 6/00

(52) U.S. Cl. ..... 428/364

(58) Field of Search ..... 428/364, 394

(56) References Cited

U.S. PATENT DOCUMENTS

| | | | |
|---|---|---|---|
| 6,132,866 | A | 10/2000 | Nelson et al. |
| 6,136,437 | A | 10/2000 | Reither |
| 6,207,275 | B1 | 3/2001 | Heffner et al. |

FOREIGN PATENT DOCUMENTS

| | | |
|---|---|---|
| DE | 41 31 746 A1 | 3/1993 |
| JP | 53-52727 | 5/1978 |
| JP | 53-52728 | 5/1978 |
| JP | 63-219616 | 9/1988 |

OTHER PUBLICATIONS

TE1/2, An Index for Relating Fiber Tenacity and Elongation, Rosenthal, Arnold J., Textile Research Journal, Jul. 1966, vol. 36, No. 7, pp. 593–602.

*Primary Examiner*—N. Edwards

(57) ABSTRACT

The processes and apparatus of the present invention concerns melt spinning high viscosity fluoropolymers into single filaments or multi-filament yams at high spinning speeds, the melt spinning being carried out at a temperature which is at least 90° C. greater than the melting point of the polymer or in the case of perfluoropolymer, at a temperature of at least 450° C., and the yams produced by the process, wherein the filaments can exhibit an orientation at the surface of the filament no greater than at the core of the filament.

14 Claims, 16 Drawing Sheets

HIGH SPEED MELT SPINNING OF FLUOROPOLYMER FIBERS

RELATED APPLICATIONS

This application is a continuation-in-part of U.S. Ser. No. 09/920,701, filed Aug. 2, 2001, which is a continuation-in-part of U.S. Ser. No. 09/857,573, filed Jun. 5, 2001, abandoned; which is a national filing from PCT application PCT/US00/02108, filed Jan. 28, 2000, which claims the benefit of U.S. applications Ser. No. 60/117,831, filed Jan. 29, 1999, and No. 60/109,631, filed Dec. 8, 1999, both now abandoned, and claims the benefit of all these applications.

BACKGROUND OF THE INVENTION

Field of the Invention

The processes and apparatus of the present invention concern melt spinning fluoropolymers into single filaments or multi-filament yams at high spinning speeds.

Melt spinning of thermoplastic copolymers based on tetrafluoroethylene is known. However, there is considerable economic incentive to drive fiber spinning rates ever higher for these high value polymers. One problem facing processes of melt spinning is that at high shear rates, melt fracture occurs which becomes evident as surface roughness in the extruded fibers. Since the critical shear rate for the onset of melt fracture decreases with increasing melt viscosity, ways to decrease melt viscosity have centered on raising the temperature of the melt. However, in many polymers including thermoplastic copolymers based on tetrafluoroethylene, the polymer exhibits thermal degradation before any significant decrease in melt viscosity can be achieved.

Fibers of polytetrafluoroethylene (PTFE) homopolymer are also highly valued, particularly for their chemical and mechanical properties, such as low coefficient of friction, thermal stability and chemical inertness. However, processing by melt spinning has proved elusive. Since polytetrafluoroethylene homopolymer fibers are conventionally formed by a dispersion spinning process involving many steps and complicated equipment, there is great economic incentive to find a method for melt spinning such fibers.

The problem of spinning fibers from high viscosity polymer melts has been previously addressed for polyesters. In U.S. Pat. No. 3,437,725 a spinneret assembly is described having a top plate, a heating plate and a lower plate with a spacer providing air space between the top plate and the heating plate. Hollow inserts, one for each filament to be spun, are placed in the top plate and extend to the bottom face of the lower plate. Molten polymer is fed into the inserts for spinning through capillaries. An electrical heater supplies heat to maintain the lower plate, heating plate and lower portions of the inserts at a temperature at least 60° C. higher than the temperature of the supplied molten polymer. Heated capillary temperatures ranging between 290 and 430° C. were listed in examples for spinning polyesters. No mention is made of any fluoropolymer or temperatures needed to melt spin fluoropolymers at high spinning speeds.

SUMMARY OF THE INVENTION

The present invention provides a process for melt spinning a composition comprising a highly fluorinated thermoplastic polymer or a blend of such polymers, comprising the steps of melting a composition comprising a highly fluorinated thermoplastic polymer or a blend of such polymers to form a molten fluoropolymer composition; conveying said molten fluoropolymer composition under pressure to an extrusion die of an apparatus for melt spinning; and extruding the molten fluoropolymer composition through the extrusion die to form molten filaments, said die being at a temperature of at least 450° C., at a shear rate of at least 100 $sec^{-1}$, and at a spinning speed of at least 500 m/min.

The present invention also provides a process for melt spinning a composition comprising polytetrafluoroethylene homopolymer, comprising the steps of melting a composition comprising a polytetrafluoroethylene homopolymer to form a molten polytetrafluoroethylene composition; conveying said molten polytetrafluoroethylene composition under pressure to an extrusion die of an apparatus for melt spinning; and extruding the molten polytetrafluoroethylene composition through the extrusion die to form molten filaments.

The present invention further provides an apparatus for melt-spinning fibers comprising a spinneret assembly comprising means for filtering; a spinneret; an elongated transfer line, said transfer line being disposed between said filtration means and said spinneret; means for heating said elongated transfer line; means for heating said spinneret; and an elongated annealer disposed beneath said spinneret assembly.

With respect to the process for melt spinning highly fluorinated hermoplastic polymer at an extrusion die temperature of at least 450° C., his high minimum temperature is required for the perfluorinated luoropolymers. Lower extrusion die temperatures can be used for hydrogen-containing highly fluorinated thermoplastic fluoropolymers, such as ethylene/tetrafluoroethylene copolymer (ETFE), which have lower melting points than the perfluorinated fluoropolymers, such as in the range of 250–270° C. for ETFE. These fluoropolymers can be spun into yarn in accordance with the process of the present invention at extrusion die temperatures which while less than 450° C., are still substantially greater than the melting point of the polymer. Thus, one embodiment for the process for melt spinning a composition comprising highly fluorinated thermoplastic polymer (including a blend of such polymers) comprises melt spinning at least one filament at a temperature of at least 90° C. greater than the melting point of said polymer. Such melt spinning temperature is the same as the extrusion die temperature mentioned above. Preferably such melt spinning temperature is at least 340° C., while for the perfluorinated thermoplastic polymers, the minimum melt spinning temperature remains at 450° C.

Another process for melt spinning highly fluorinated thermoplastic polymer, comprises carrying out the melt spinning into at least one filament and shielding the resultant molten filament from turbulent air to delay solidification of the filament until it reaches a distance of at least 50× the diameter of the die through which the filament is melt spun.

While each of the foregoing described processes can be carried out on the melt spinning of one filament of the fluoropolymer, it is preferred that the melt spinning produce a plurality of filaments, preferably at least about 3, more preferably at least about 10, to form a yam thereof.

Another embodiment of the present invention is the melt spun yam itself. It has been found that in the melt spinning of the highly fluorinated thermoplastic polymers in accordance with the process of the present invention, at least about 90° C. above the melting point of the polymer in general and at a temperature of at least about 450° C. for the perfluorinated thermoplastic polymers,.or utilizing the shielding of the molten polymer to uniformly cool the filament(s) and thereby delay solidification, the resultant yam, whether monofilamentary or multifilamentary, has a novel cross-sectional structure, characterized by the core of the filament(s) having a greater axial orientation than the surface of the filament(s). In the normal melt spinning of such polymers, i.e. at temperatures considerably below those used in the present invention for the respective polymers being melt spun into filament(s), orientation of the molecules within the filament occurs upon the drawing of the yarn, either at a high rate of melt draw from the spinneret or such melt stretch followed by draw of the yam after it has solidified, i.e. draw below the melting point of the copolymer. Normally, such stretch, whether melt stretch or melt stretch plus subsequent draw causes the highest orientation of the molecules making up the filament to occur at the surface of the filament, because that is where the shear stress on the copolymer is the greatest, by virtue of the filament cooling from the surface of the filament before the core cools. Thus, while the molecules at the surface of the filament become aligned in the axial direction of the filament, the molecules in the core of the filament show less alignment. Draw of the filament accentuates the difference between surface and core orientations. This orientation phenomenon is further described in A. Ziabicki and H. Kawai, High-Speed Fiber Spinning, John Wiley & Son (1985) on p. 57. Filament(s) present in the highly fluorinated thermoplastic polymer yam of the present invention have reverse orientation, wherein the molecular orientation is greater in the core than at the surface of filament(s) present in the yam.

Drawing of the yarn after melt spinning can produce a variation on the above-described novel structure, namely wherein the orientation at the surface of the filament is no greater than the orientation at the core of the filament. Thus the orientation present at the surface of the filament can be the same as the orientation present in the core of the filament. The orientation difference between surface and core diminishes from that described above with increasing draw ratio. Thus, as the draw ratio reaches at least about 3, the detection of lesser orientation at the surface becomes more and more difficult.

In terms of forming the novel yarn of the present invention, the process of the present invention can also be described as melt spinning the polymer at a temperature above the melting point of the polymer which is effective to produce such yarn wherein the orientation in the filament(s) thereof is either greater in the core of the filament than at the surface thereof or the orientation at the surface of the filament is no greater than in the core thereof. The parameters of minimum shear rate and spinning speed described above are preferred for each of the process definitions for the present invention.

The present invention is particularly noteworthy in producing yam of ethylene/tetrafluoroethylene copolymer of high tenacity and at high rates and of fine denier/filament sizes and high denier uniformity along the length of the yarn, a preferred embodiment being set forth in Example 34. Preferred ETFE yams have a tenacity of at least 3.0 g/den and tensile quality of at least 8. Even more preferred ETFE yams are those having a tenacity of at least 3.0 g/den and an X-ray orientation angle of less that 19°. Each of these preferred yams, more preferably have a tenacity of at least 3.2 g/den, and the ETFE from which the yam is made has a melt flow rate of less than 45 g/10 min. These yarns while preferably having the orientation within filaments as described above are not limited to yams having such orientation.

The availability of the ETFE yam just described has enabled such yam to be used in a wide variety of applications, as disclosed in Examples 27 to 33.

BRIEF DESCRIPTION OF THE DRAWINGS

FIG. 10B is an enlarged view of a portion of FIG. 10A.

DETAILED DESCRIPTION

Figure 1:
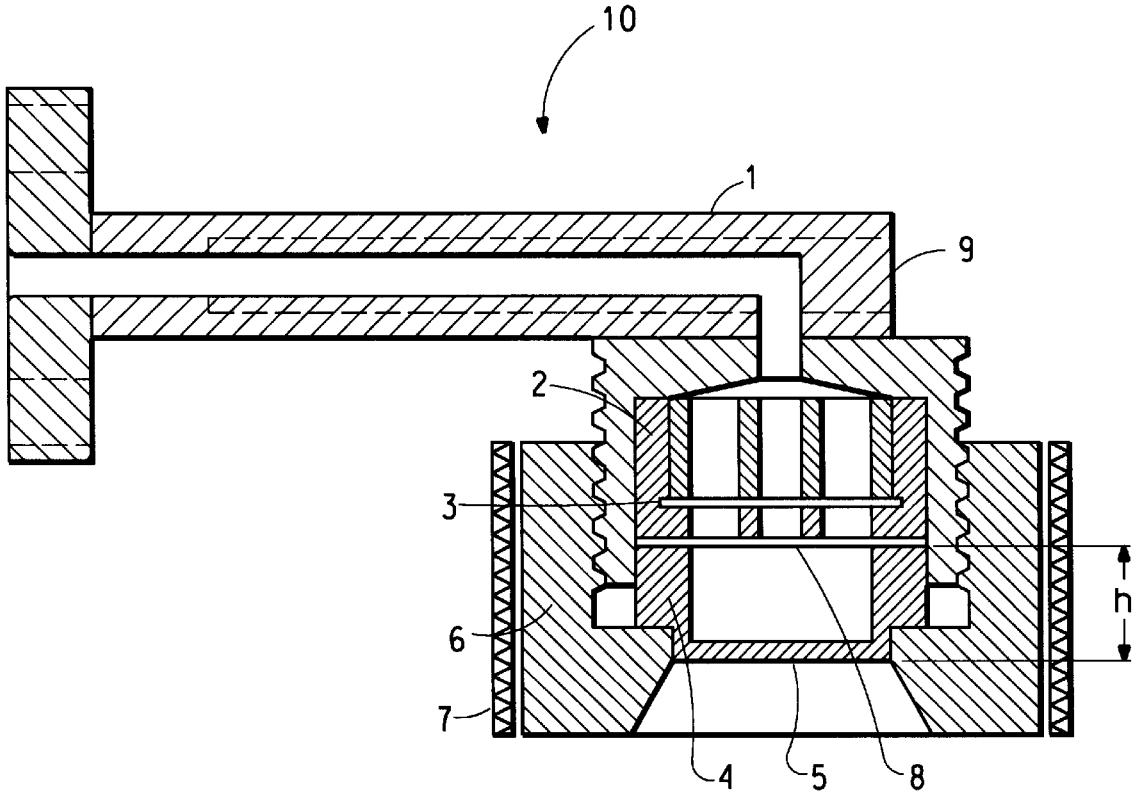
FIG. 1 is a cross-sectional view of a portion of a conventional apparatus for melt spinning.

The process of the present invention affords the benefits of high temperature spinning while avoiding the pitfalls thereof. In the process of the present invention, the composition comprising highly fluorinated thermoplastic polymer or blend of such polymers can be exposed to temperatures above the degradation temperature of the polymers for times sufficient to cause a decrease in melt viscosity but insufficient for significant polymer degradation to occur. In melt spinning, the molten composition experiences the highest shear rate during its transit through the extrusion die, i.e. capillaries, of the spinneret of the melt spinning apparatus. In the process of the present invention, it is at that point that the molten composition can be heated to a temperature above the degradation temperature of the highly fluorinated polymer. Because of the high throughput speed achievable in the present invention due to the elevated temperature, the residence time of the composition in the extrusion die is kept to a minimum.

Accordingly, the present invention provides a first process for melt spinning a composition comprising a highly fluorinated thermoplastic polymer or a blend of such polymers, comprising the steps of melting a composition comprising a highly fluorinated thermoplastic polymer or a blend of such polymers to form a molten fluoropolymer composition; conveying said molten fluoropolymer composition under pressure to an extrusion die of an apparatus for melt spinning; and extruding the molten fluoropolymer composition through the extrusion die to form molten filaments, said die being at a temperature of at least 450° C., at a shear rate of at least 100 $sec^{-1}$, and at a spinning speed of at least 500 m/min. The terms extrusion die and spinneret are used herein interchangeably as meaning the same thing; the same is true for the terms extrusion orifice (or aperture) and capillary.

In the melting step, a composition including a highly fluorinated thermoplastic polymer or a blend of such polymers is melted. Highly fluorinated thermoplastic polymers for the purpose of this first process include homopolymers other than polytetrafluoroethylene (PTFE), such as polyvinylidene fluoride (PVDF), and copolymers, such as copolymers of tetrafluoroethylene (TFE) prepared with comonomers including perfluoroolefins, such as a perfluorovinylalkyl compound, a perfluoro(alkyl vinyl ether), or blends of such polymers. The term "copolymer", for purposes of this invention, is intended to encompass polymers comprising two or more comonomers in a single polymer. A representative perfluorovinylalkyl compound is hexafluoropropylene. Representative perfluoro(alkyl vinyl ethers) are perfluoro(methyl vinyl ether) (PMVE), perfluoro(ethyl vinyl ether) (PEVE), and perfluoro(propyl vinyl ether) (PPVE). Preferred highly fluorinated polymers are the copolymers prepared from tetrafluoroethylene and perfluoro(alkyl vinyl ether) and the copolymers prepared from tetrafluoroethylene and hexafluoropropylene. Most preferred copolymers are TFE with 1–20 mol % of a perfluorovinylalkyl comonomer, preferably 3–10 mol % hexafluoropropylene or 3–10 mol % hexafluoropropylene and 0.2–2 mol % PEVE or PPVE, and copolymers of TFE with 0.5–10 mol % perfluoro(alkyl vinyl ether), including 0.5–3 mol % PPVE or PEVE. In addition to the perfluorinated thermoplastic tetrafluoroethylene copolymers described above, such highly fluorinated thermoplastic polymers as ethylene/tetrafluoroethylene copolymers (ETFE) can also be used in the present invention. Such ETFE is a copolymer of ethylene and tetrafluoroethylene, preferably containing minor proportions of one or more additional monomers to improve the copolymer properties, such as stress crack resistance. U.S. Pat. No. 3,624,250 discloses such polymers. The molar ratio of E (ethylene) to TFE (tetrafluoroethylene) is from about 40:60 to about 60:40, preferably about 45:55 to about 55:45. The copolymer also preferably contains about 0.1 to about 10 mole % of at least one copolymerizable vinyl monomer that provides a side chain containing at least 2 carbon atoms. Perfluoroalkyl ethylene is such a vinyl monomer, perfluorobutyl ethylene being a preferred monomer. The polymer has a melting point of from about 250° C. to about 270° C., preferably about 255° C. to about 270° C. Melting point is determined according to the procedure of ASTM 3159. In accordance with this ASTM procedure, the melting point is the peak of the endotherm obtained from the thermal analyzer. Preferably, the ETFE used in the present invention has a melt flow rate (MFR) of less than 45 g/10 min using a 5 kg load in accordance with ASTM D 3159, wherein the melt temperature of 297° C. is specified. More preferably, the MFR of the ETFE is no more than 35 g/10 min and is at least 15 g/10 min, preferably at least 20 g/10 min. As the MFR increases from 35 g/10 min, resulting from reduced molecular weight of the polymer, the advantage of higher in melt spin rate becomes counterbalanced by reduced strength (tenacity) of the yam from the reduced molecular weight polymer, such that upon reaching an MFR of 45 g/10 min, the decrease in tenacity outweighs the increase in production rate. As the MFR decreases from 20 g/10 min, the difficulty in extruding the more viscous polymer increases, leading to uneconomical melt spin rates, until an MFR of 15 g/10 min is reached, below which the polymer is barely melt spinnable through the small extrusion orifices required for yam. Also suitable for the practice of this invention are blends of the highly fluorinated thermoplastic polymers including blends of TFE copolymers.

The fluoropolymers suitable for the practice of the present invention except for ETFE preferably exhibit a melt flow rate (MFR) of 1 to about 50 g/10 minutes as determined at 372° C. according to ASTM D2116, D3307, D1238, or corresponding tests available for other highly fluorinated thermoplastic polymers.

The composition comprising the highly fluorinated thermoplastic polymer or a blend of such polymers can further comprise additives. Such additives can include, for example, pigments and fillers.

In the present process the composition comprising the highly fluorinated polymer or blend of such polymers, discussed above, is melted to form a molten fluoropolymer composition. Any means known in the art for providing a melt can be used. A representative method can include introducing the fluoropolymer composition to an extruder which is heated to a temperature sufficient to melt the composition but below the degradation temperature of the highly fluorinated thermoplastic polymer or blend of such polymers. This temperature is dependent upon the particular polymers used.

Once the composition is in a molten state, it is conveyed under pressure to an extrusion die, such as a spinneret, of an apparatus for melt spinning. Means of conveying compositions to the extrusion die are well known in the art and include apparatus with a ram or piston, a single screw or a twin-screw. In a preferred embodiment of the process of the present invention, an extruder is employed to melt and convey the molten composition suitable for the practice of this invention to a single or multi-aperture strand extrusion die to form, respectively a monofilament or multifilament fiber product. The extruder barrel and screw, and the die are preferably made from corrosion resistant materials including high nickel content corrosion resistant steel alloy, such as Hastelloy C-276 (Cabot Corp., Kokomo, Ind.). Many suitable extruders, including screw-type and piston type, are know in the art and are available commercially. A metering device, such as a gear pump, may also be included to facilitate the metering of the melt between the screw and the spinneret.

In the process of the present invention, after the molten fluoropolymer composition is conveyed to the extrusion die, it is extruded through the apertures of the extrusion die, said die being at a temperature of at least 90° C. greater than the melting point of the polymer or in the case of perfluorinated thermoplastic polymers, at least 450° C., at a shear rate of at least 100 $sec^{-1}$, and at a spinning speed of at least 500 m/min. The temperatures disclosed herein relate to the melt processing of the fluoropolymer and the treatment of the spun yam (monofilament or multifilament) are temperatures to which the equipment is heated and come close to actual polymer or yam temperature by virtue of placement of thermocouples.

The apertures of the extrusion die can be of any desired cross-sectional shape, with a circular cross-sectional shape preferred. The diameter of a circular cross-sectional aperture found suitable for use in the process of the present invention can be in the range of about 0.5 to 4.0 mm, but the practice of this invention is not limited to that range. For example, Example 1 uses an aperture diameter of 0.4 mm (15 mil). The length to diameter ratio of the extrusion die aperture useful in the present invention is preferably in the range of about 1:1 to about 8:1. Although the hole pattern is not critical, it is preferred if the holes are arranged in one or two concentric circles, with a single circle arrangement being more preferred.

FIG. 1 depicts a portion of a conventional melt spinning apparatus for thermoplastic polymers, spinneret assembly 10. Shown are adapter 1 which may be heated with a cartridge heater inserted within space 9 located between the dotted lines along adapter 1, which is attached to means for conveying and melting the fluoropolymer composition (not shown), filter pack 2 containing melt filtration means 3, typically screens, and conventional spinneret 4 having face plate 5, face plate 5 being disposed at one end of spinneret 4 at a distance, h, from the opposite end of spinneret 4. Spinneret 4 is disposed adjacent bottom face 8 of filter pack 2, and together with filter pack 2 is affixed to adapter 1 by retaining nut 6. Spinneret assembly 10 is heated by band heater 7 circumferentially disposed around retaining nut 6. In FIG. 1, spinneret 4 is generally heated by its conductive contact with retaining nut 6.

In the conventional spinneret assembly design of FIG. 1, there is no convenient way to heat only face plate 5 of spinneret 4 because spinneret 4 resides entirely within retaining ring 6. Any attempt to super-heat face plate 5 would result in heating a considerable portion of other areas of spinneret assembly 10 to a similar if somewhat lower temperature. This undesirable heating of areas besides face plate 5 of spinneret assembly 10 to temperatures at or above the degradation temperature of the fluoropolymer composition would result in an undesirably long duration of exposure of the fluoropolymer composition to high temperature and could lead to excessive polymer degradation under some circumstances.

During extrusion in the present invention, the extrusion die is heated to a temperature of at least 90° C. above the thermoplastic polymer melting point or to at least 450° C., as the case may be. For certain fluoropolymer compositions herein, the extrusion die can be heated to temperatures greater than about 500° C. Heating to these temperatures without degradation of the fluoropolymer composition can be done by thermally isolating the extrusion die from other areas of the melt spinning apparatus that may contain the fluoropolymer composition. When the molten fluoropolymer composition begins to pass through the extrusion die, the elevated temperature of the die thereof induces a rapid decrease in polymer melt viscosity, permitting a high rate of transmission through the extrusion die. To avoid thermal degradation, it is necessary to reduce the residence time of the melt at the high temperatures. Since degradation is a function not only of temperature but also of time, if the temperature is high, it is preferred that the residence time be minimized. Thus, the present invention provides the highest temperature in the area where it would be most beneficial, namely the extrusion die, e.g. the walls of the spinneret capillary holes, which are in the face plate of the spinneret. Therefore, the extrusion die can be kept thermally isolated from other areas of the melt spinning apparatus that may be in contact with the fluoropolymer composition.

In the case of ETFE, an extrusion die (melt spinning) temperature less than 450° C. is necessary. As disclosed on pages 309 and 306 of J. Scheirs, Modem Fluoropolymers, John Wiley & Sons (1997), ETFE decomposes above 340° C. to oligomer and rapidly degrades at temperatures over 380° C. The melt spinning of the present invention is able to operate within this temperature range of 340–380° C. because of the short time of exposure of the ETFE to this temperature. Because of the rapidity of the decomposition at temperatures above 380° C., and the danger of explosion from pressure build-up with the spinneret, it is preferred that the melt spinning temperature be no greater than 380° C.

The spinneret or a portion thereof that includes the face plate can be heated independently of other areas of the spinneret assembly. Any means for providing highly localized heating to a temperature of at least 90° C. above the polymer melting point or at least 450° C. as the case may be can be employed for the practice of the invention. Such means includes a coil heater, a cartridge heater, a band heater, and apparatus for radio frequency, conduction, induction or convective heating, such as an induction heater. Insulation may be used, such as ceramic insulation, to provide off-sets and thereby thermal isolation between the face plate and other areas of the melt spinning apparatus that may be in contact with the fluoropolymer composition. Use of one or more cooling jackets can also be used on areas of the spinneret or spinneret assembly other than the extrusion die to provide thermal isolation of the extrusion die.

In order to facilitate the thermal isolation of the extrusion die, it has been found satisfactory in one embodiment of the present invention to offset the spinneret face plate from the spinneret body by simply increasing the distance, h, between the ends of the conventional spinneret shown in FIG. 1. Increasing the distance in this manner, shown in FIG. 2 as h', enables separate heating of the spinneret face plate from the bulk of the remainder of the spinneret assembly. Thus, the spinneret face plate of the present invention in one embodiment is separated from the bottom face of the filter pack by distance h' which distance is sufficient to allow separate heating of the spinneret face plate.

Figure 2:
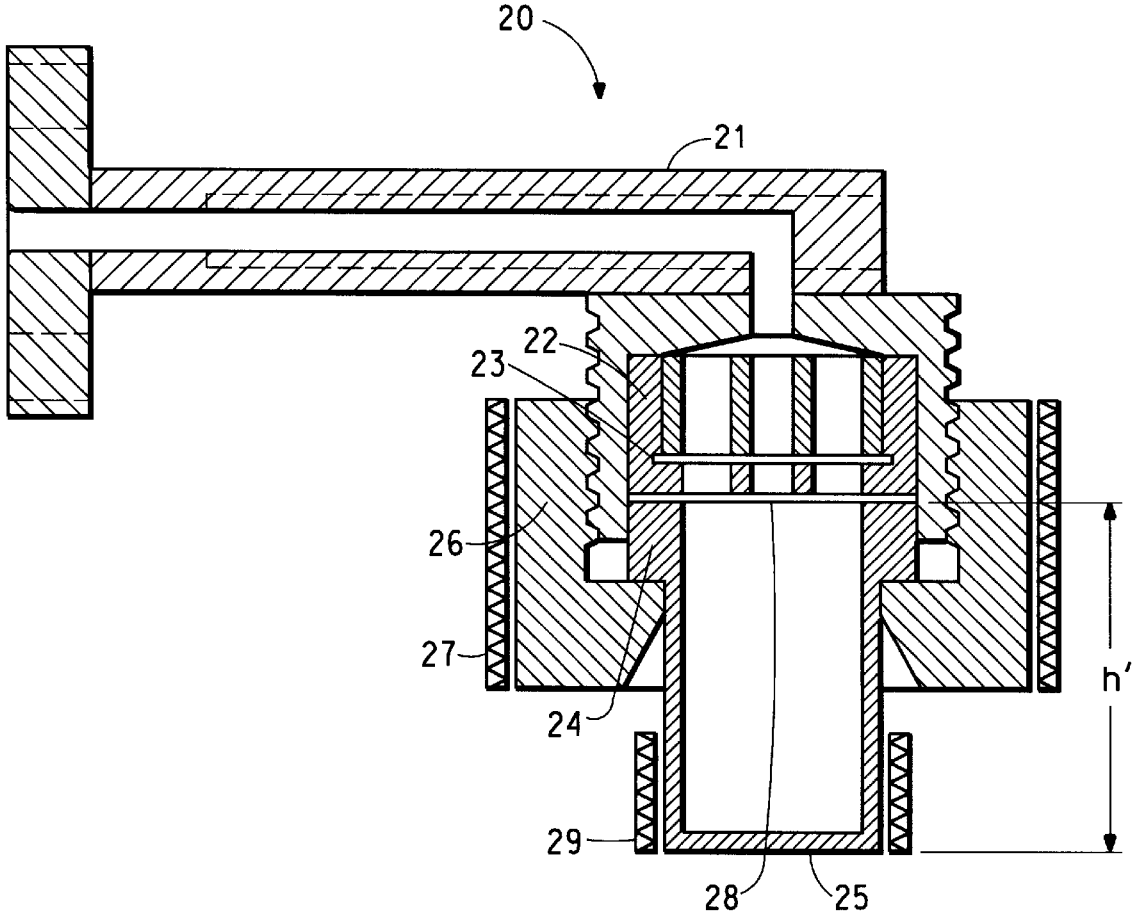
FIG. 2 is a cross-sectional view of one embodiment of a portion of a melt spinning apparatus of the present invention having an elongated spinneret.

In FIG. 2 is shown spinneret assembly 20 having adapter 21 which is attached to means for melting and/or conveying the fluoropolymer composition (not shown), filter pack 22 containing screen 23 and bottom face 28, elongated spinneret 24 having face plate 25 being disposed at one end of spinneret 24 at a distance, h', from the opposite end of spinneret 24 at bottom face 28 of filter pack 22, wherein h'>h other measurements of FIG. 1 and 2 held equal, to enable face plate 25 to extend outside of retaining nut 26. With face plate 25 thus protruding from retaining nut 26, heating means 29 can be used to separately heat face plate 25, and thus face plate 25 is thermally isolated from the remainder of the spinneret assembly. Heating means 27, such as a band or coil heater, is disposed circumferentially around retaining nut 26.

Heating means 27 and 29 can be a conduction heater, a convection heater, or an induction heater.

Figure 3:
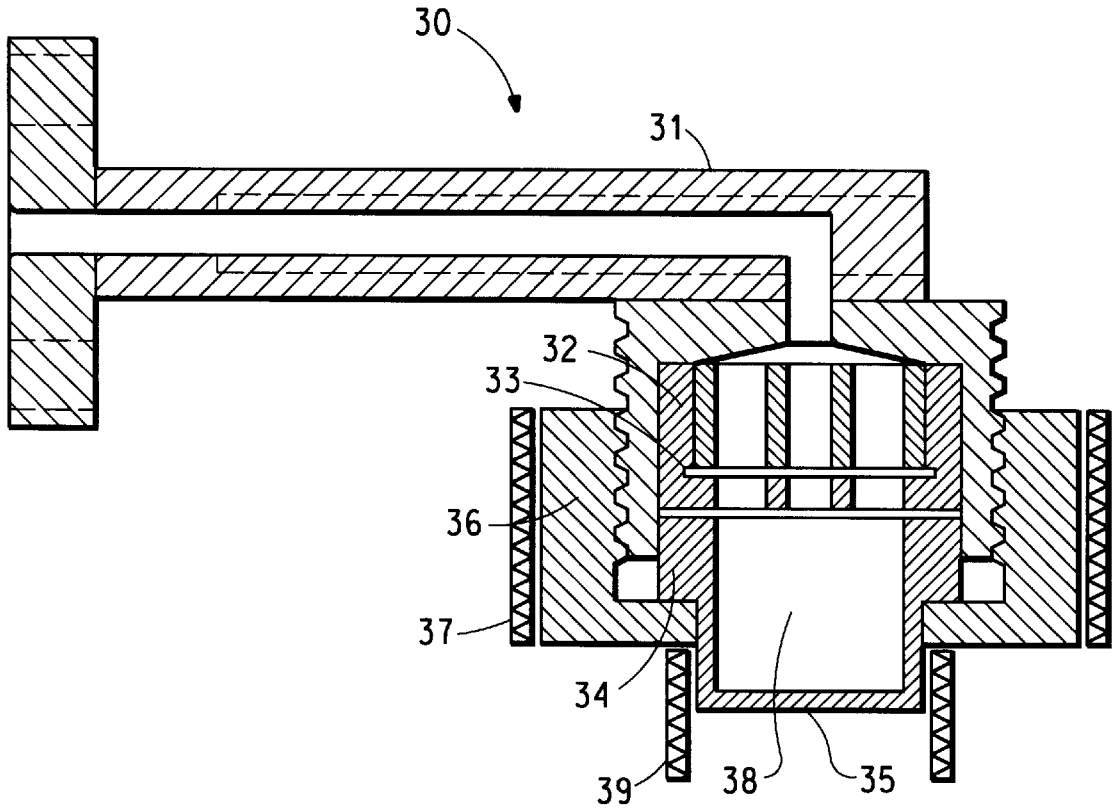
FIG. 3 is a cross-sectional view of one embodiment of a portion of a melt spinning apparatus having a shortened elongated spinneret.

An alternative embodiment of a spinneret assembly useful in the present invention is shown in FIG. 3 as spinneret assembly 30. In this embodiment, the bottom part of retaining nut 26 of FIG. 2 is reduced in size, e.g. the retaining nut is thinner, see retaining nut 36 in FIG. 3. Here, the body of elongated spinneret 34 is shortened relative to the length of spinneret 24 of FIG. 2, and yet spinneret 34 is elongated (relative to spinneret 4 of FIG. 1) so as to extend beyond retaining nut 46 enabling face plate 35 to be heated separately, by means 39, from means 37 shown for heating another area of the spinneret assembly. Also shown is adapter 31 which is attached to means for melting and/or conveying the fluoropolymer composition (not shown), filter pack 32 and filtration means 33, and channel 38.

Figure 4:
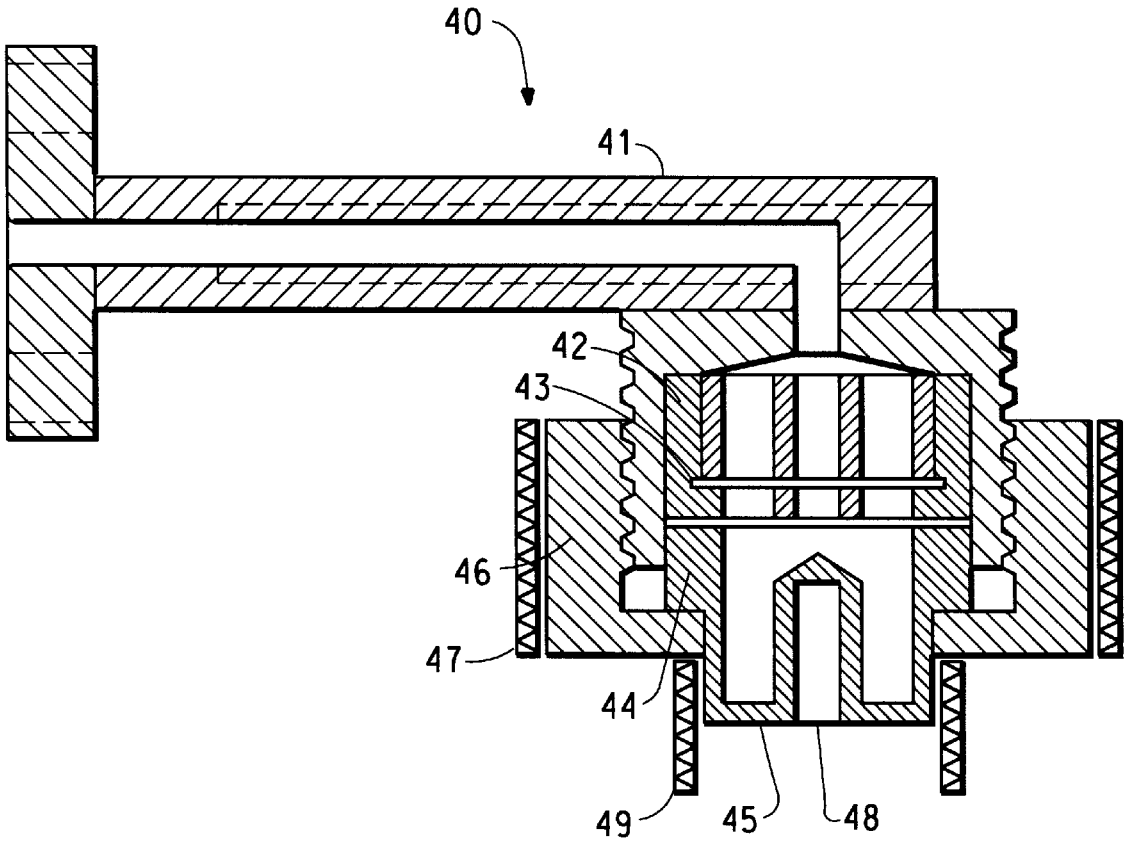
FIG. 4 is a cross-sectional view of one embodiment of a portion of a melt spinning apparatus of the present invention having a shortened elongated spinneret with heating means disposed within a center cavity thereof and heating means disposed on an outer surface thereof.

In the above embodiments of the present invention, molten composition conveyed into the spinneret can be heated by means disposed around the outside wall of the spinneret, and thus the temperature of the melt adjacent the walls of the apertures is higher than the temperature in the center of the melt. The effect of this temperature non-uniformity, highest at the outside and cooling toward the center of the melt, can cause extruding filaments to bend toward the center of the spinneret. The bent angle has been observed higher than 45 degrees at high jet velocity for certain fluoropolymer compositions. The impact of this phenomenon can be reduction in attainable high speed filament continuity. In order to reduce any temperature gradient between the outermost and innermost parts of the polymer melt, a heating means is provided within aperture 48, such as a cartridge heater, can be introduced into the center of elongated spinneret 44, as shown in the spinneret assembly 40 of FIG. 4. Also shown in FIG. 4 are adapter 41 which is attached to means for melting and/or conveying the fluoropolymer composition (not shown), filter pack 42, filtration means 43, retaining nut 46, heating means 47 and 49, and face plate 45.

Figure 5:
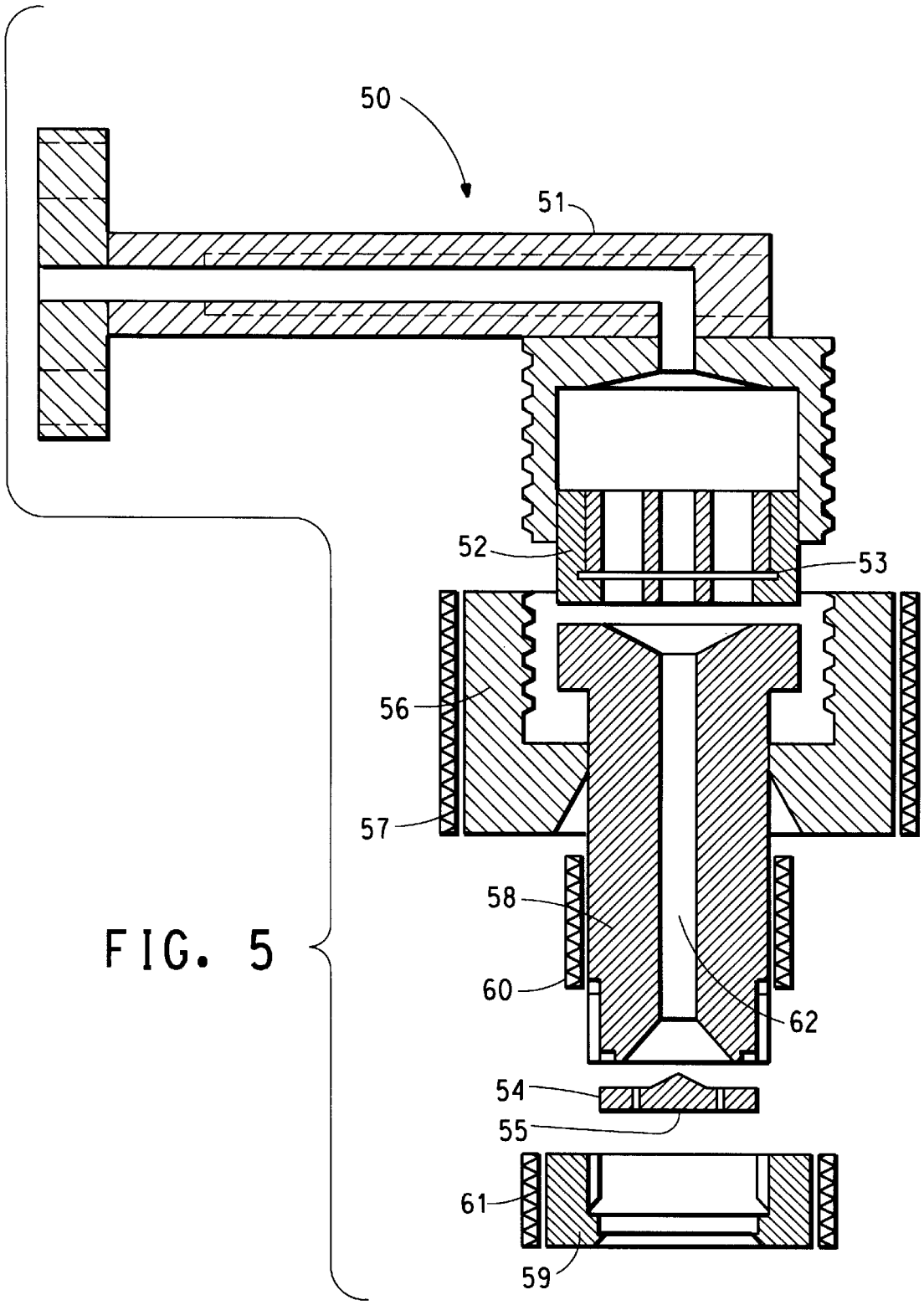
FIG. 5 is an exploded cross-sectional view of one embodiment of a melt spinning apparatus of the present invention featuring an elongated transfer line disposed between a pack filter and a spinneret disc.
Figure 6:
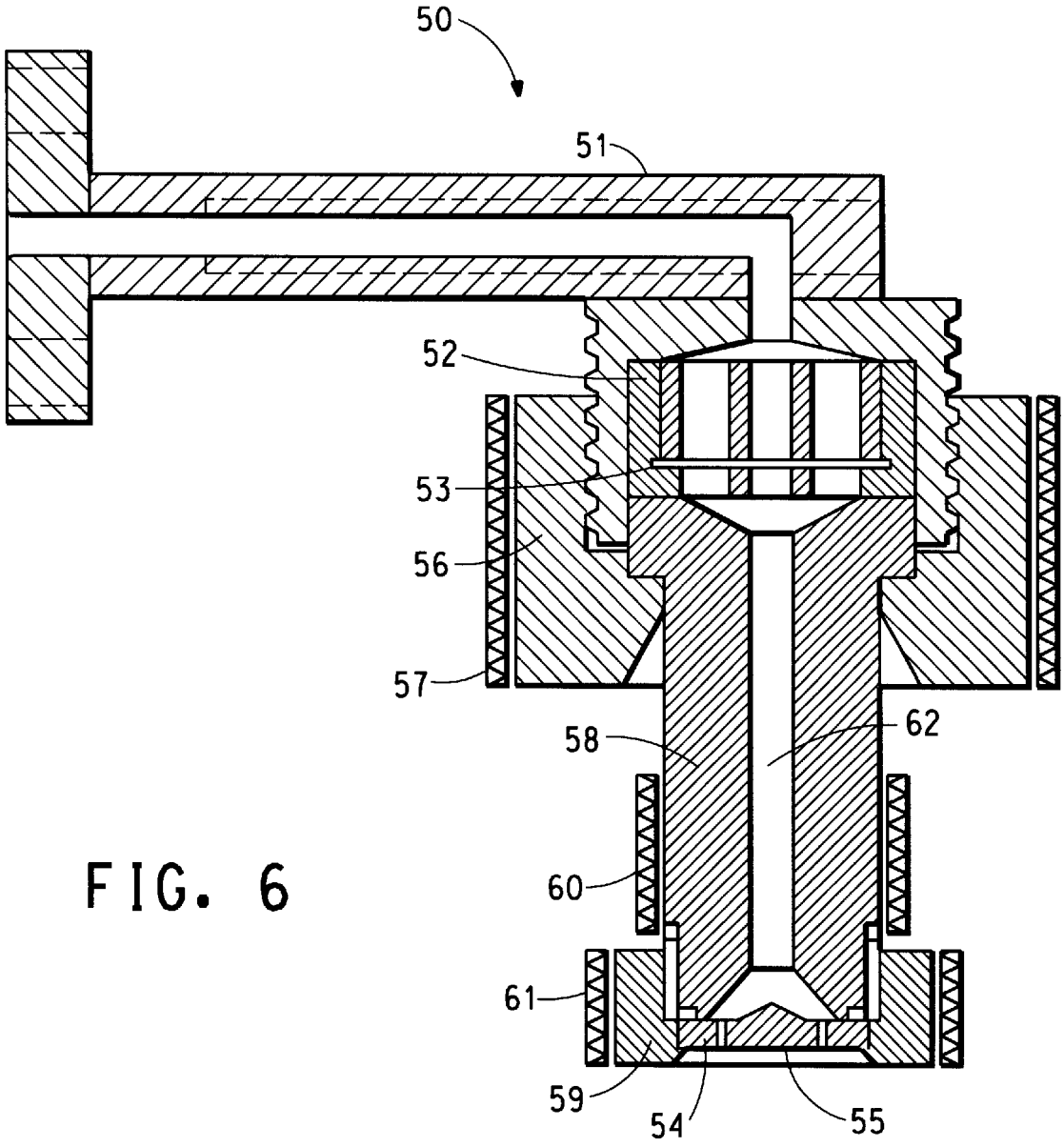
FIG. 6 is an assembled cross-sectional view of the melt spinning apparatus of FIG. 5.

A further embodiment provided by the present invention, shown in FIGS. 5 and 6 as spinneret assembly 50, is to heat the melt faster and through narrow channel 62 (relative to channel 38 of FIG. 3) provided within transfer line 58, and reduce the volume directly upstream to spinneret face plate 55. By reducing the volume, the residence time is reduced. This embodiment also provides the opportunity to provide an intermediate temperature zone for the composition while in channel 62 of transfer line 58 through use of heating means 60. Thus, the present process can further include exposing the fluoropolymer composition to an intermediate temperature ranging from the melt temperature of the fluoropolymer composition to a temperature less than the temperature of the extrusion die, e.g. at the face plate of the spinneret. As shown, the portion of transfer line 58 adjacent filter pack 52 can be heated via heating means 57 disposed circumferentially around retaining nut 56. The fluoropolymer composition within channel 62 of transfer line 58 can be pre-heated to at least one intermediate temperature which can range from above the melting temperature of the fluoropolymer composition to a temperature lower than the temperature at face plate 55 via heating means 57 and/or heating means 60. Face plate 55 is shown in this embodiment as being separately heated via heating means 61 held in spinneret sleeve 59. Transfer line 58 is disposed downstream of filter pack 52 and filtration means 53 and followed by spinneret 54, shown having a disc shape. Spinneret 54 can be removable for cleaning and replacement without removal of pack filter 52. Transfer line 58 is also removable by unscrewing retaining nut 56. Also shown is adapter 51 which is attached to means for melting and/or conveying the fluoropolymer composition (not shown).

Figure 7:
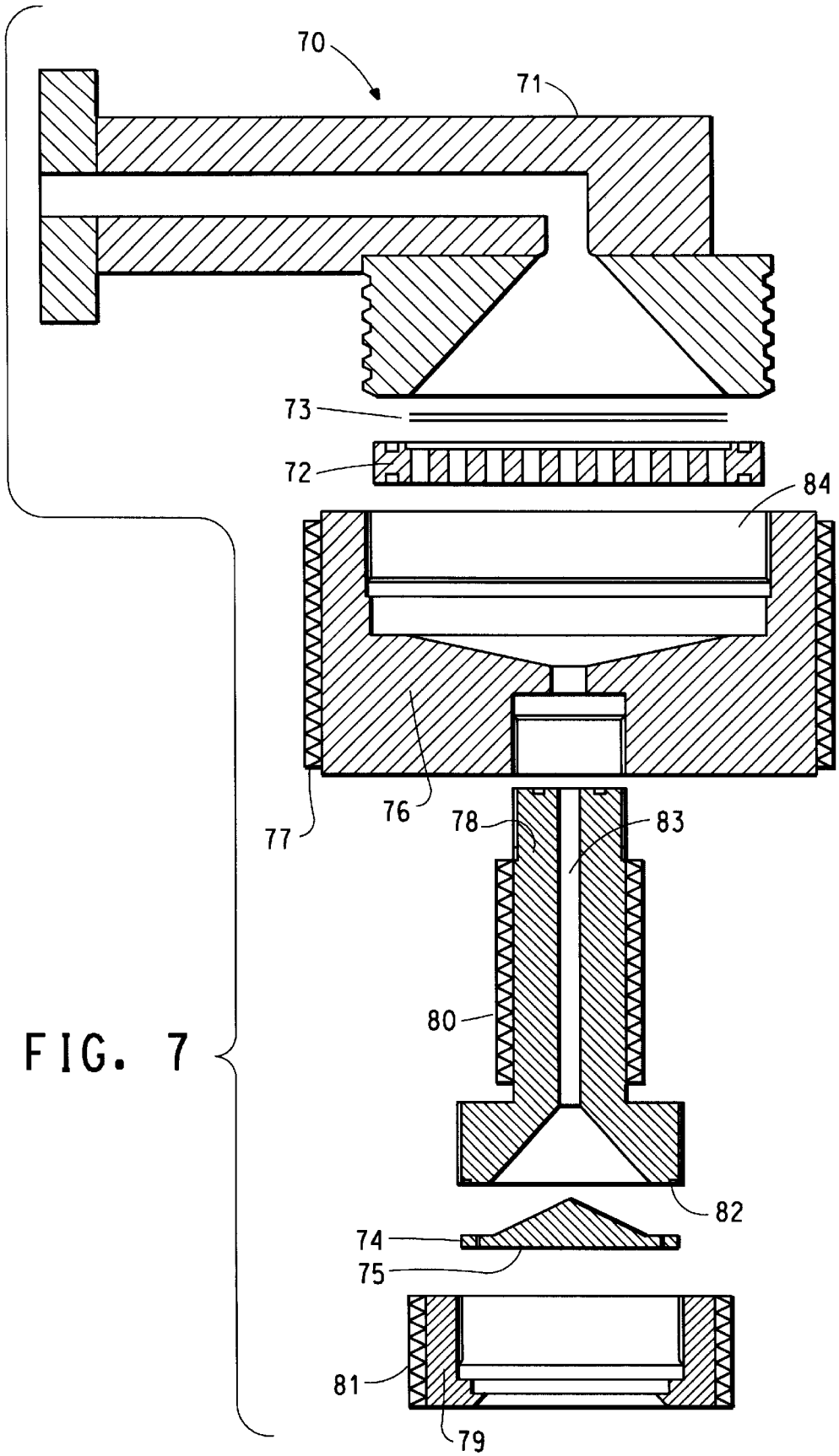
FIG. 7 is an exploded cross-sectional view one embodiment of a melt spinning apparatus of the present invention featuring another embodiment of an elongated transfer line and spinneret disc.
Figure 8:
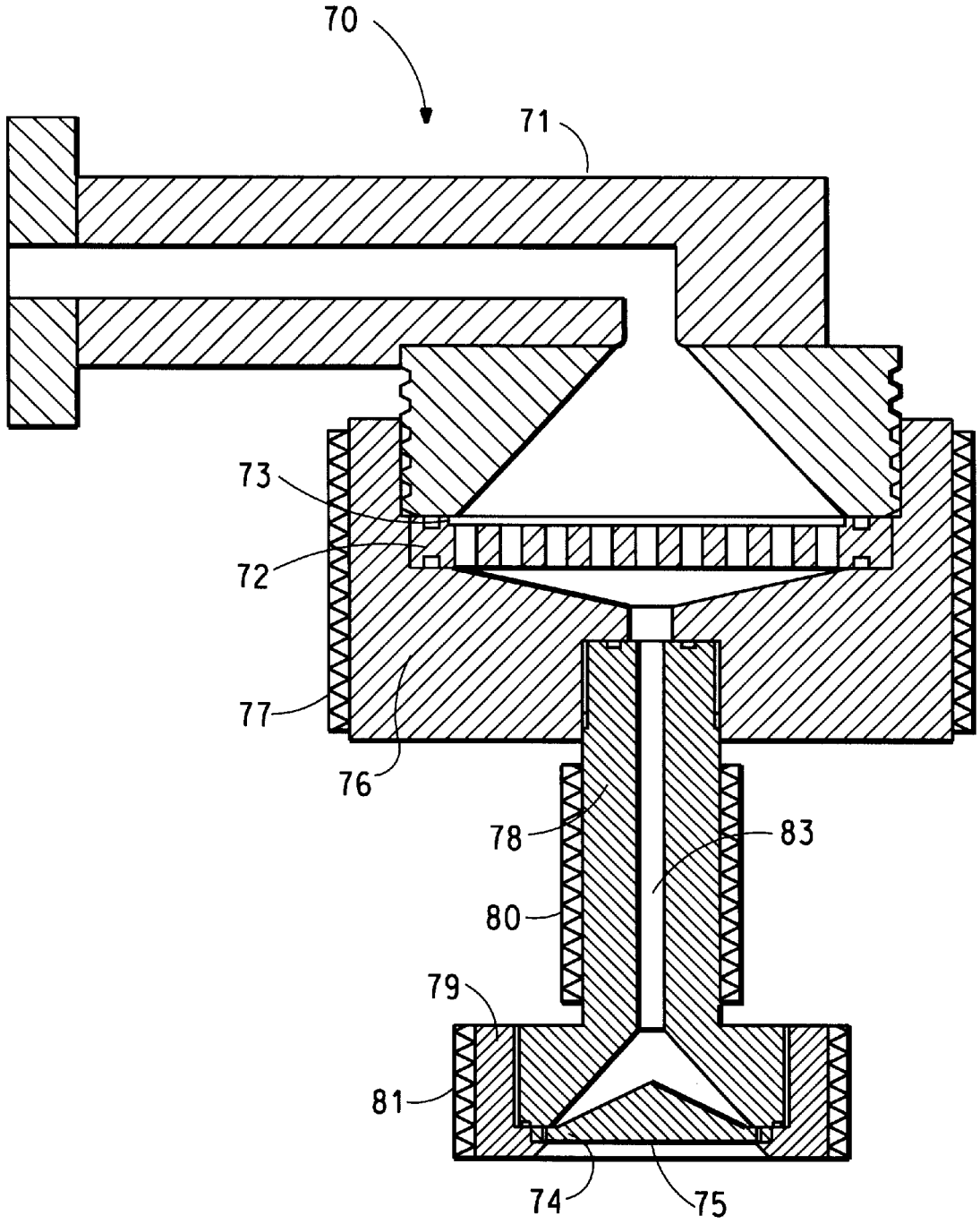
FIG. 8 is an assembled cross-sectional view of the melt spinning apparatus of FIG. 7.

FIGS. 7 and 8 show spinneret assembly 70 of the present invention which embodiment ermits removal of transfer line 78 and can accommodate larger diameter disc spinnerets relative to the embodiment shown in FIGS. 5 and 6, such as spinneret 74. Spinneret nut 79 holds disc spinneret 74 having face plate 75 to the bottom of face 82 of transfer line 78. Narrow internal flow channel 83 in transfer line 78 reduces the volume and residence time of the fluoropolymer composition at high temperature to further reduce the chance of degradation. Transfer line 78 also provides a means of stepping up to an intermediate temperature between filtration means 73 and spinneret 74 via its separate heating means 80. At the same time, the transfer line embodiment shown provides more uniform and faster heat transfer. An additional advantage of this embodiment is that disc spinneret 74 can be replaced without having to remove the filter pack, and the disc can be easier to fabricate. Also shown are adapter 71, which is attached to means for melting and/or conveying the fluoropolymer composition (not shown), plate 72 which has multiple distribution channels providing support for filtration means 73, retaining nut 76 surrounded by heating means 77, chamber 84 disposed between filtration means 73 and transfer line 78, and face plate 75.

It is believed that the present process provides self-melt lubricated extrusion. By "self-melt lubricated extrusion" is meant that only the skin of the extrudate, the portion of the melt directly adjacent the walls of the apertures, becomes heated to extremely high temperature by the very hot die aperture surface resulting in very low viscosity of this portion of the melt while keeping the bulk of the extrudate to a lower temperature due to the short contact or residence time. The considerably reduced viscosity of the outer layer skin behaves like a thin lubricating film thus permitting the extrusion to become plug flow, wherein the bulk of the extrudate experiences uniform velocity. It is this low viscosity surface effect that provides yam of the present invention wherein its filaments exhibit reverse orientation, i.e. the orientation at the filament surface is less than in the center of the filament.

The greater orientation in the core in the filament(s) of the yam of the present invention can be determined several ways. Thermoplastic fluoropolymer yam such as of ETFE which is spun at lower temperatures than the present invention, such as 300–320° C., is characterized by the yam filaments exhibiting a fibrillar surface appearance when viewed under a scanning electron microscope at 10,000× magnification, with the fibrils running in the direction of the longitudinal axis of the filaments, indicative of a high degree of surface orientation. In contrast, under the same conditions of viewing of the yam filaments of the present invention, the surface of such filaments does not exhibit a fibrillar appearance, indicating the absence of any high degree of orientation. Instead, the surface appearance of such fibers is of a fine texture, free of striations. While the surface of the filaments does not indicate any high degree of orientation, the core of the filaments indicates high orientation as revealed by the birefringence of the filaments being substantially greater than the birefringence of the unoriented fluoropolymer, e.g. unoriented ETFE has a birefringence of 0.040. Birefringence is a typical way of characterizing orientation, the higher the birefringence, the greater the orientation. The birefringence of the entire filament is the bulk birefringence of the filament and can be determined as disclosed in Col. 4 of U.S. Pat. No. 2,931,068. Birefringence measurements can also be taken at increments across the radius of the filament, so that the birefringence at the surface of the filament can be compared to the birefringence at the core or center of the filament, i.e. differential birefringence, thereby indicating the orientation at the surface of the filament relative to the orientation at the core. Because the orientation or lack of orientation at the filament surface is a surface phenomenon, and birefringence measurement must be taken within the body of the filament, the birefringence measurement for the surface is taken as near as possible to the surface to ascertain the trend of birefringence in the direction from the center of the filament to the filament surface. Thus in addition to birefringence measurement taken at the center of the filament, birefringence measurements are also made along 10 the radius of the filament towards the filament surface, with the region 0.8–0.95 radius being the region which indicates the birefringence trend towards the surface, or in other words the surface orientation relative to the orientation in the center of the filament. The birefringence measurement can be made on an individual filament, such as a monofilament or a filament of a multifilament yam. This localized birefringence measurement, as distinguished from the bulk birefringence measurement, can also be taken on 10 filaments of a multifilament yam, from the center to one side, and the reverse orientation for the yam can be indicated by the average of the 10 birefringence measurements at each increment along the filament radius indicating a trend towards lower birefringence, especially in the 0.8–0.95 radius region, as compared to the birefringence measurement for the filament center, thereby indicating that the orientation at the surface is less than in the filament center. Orientation wherein the orientation is greater at the surface than in the center of the filament is determined the same way, wherein the trend towards increasing orientation at the surface is indicated by the trend of increasing birefringence as the measurements approach the surface. These differential birefringences can be determined by the procedure disclosed in British patent 1,406,810 (pp. 5 and 6), except that the use of the Leitz Mach-Zehnder Interferometer is preferred.

At high draw ratios, e.g. at least 3×, the birefringence difference between the center of the filament and the surface of the filament, i.e. the lower birefringence at the surface of the filament, tends to diminish and may even disappear, depending on how high the draw ratio is above 3×, because of the high degree of orientation of the crystals within the filament as a result of the high draw ratio. Thus, the higher the tenacity of the filament, e.g. at least 3 g/den, the smaller the difference between the lower birefringence at the surface of the filament and the higher birefringence at the filament center. For such high tenacity filaments, the birefringence difference may disappear, such that the birefnngence at (near) the surface of the filament may simply be no greater than the birefringence at the center of the filament. The birefringence difference present earlier in the processing of the filament, e.g. as developed by spin-stretch and/or as developed in the initial drawing of the filament before reaching the draw ratio of at least 3×, either diminishes or disappears.

ETFE filaments melt spun at high temperature and drawn to high draw ratios at high speed to tenacities of at least 3.0 g/den exhibit different scanning electron microscope appearance at high magnifications than described above. ETFE filament melt spun at 350° C. and drawn to a draw ratio of 4.0 as part of the yarn described in Example 34 (yam tenacity of 3.45 g/den) has a scanning electron microscope appearance at 3000× magnification of circumferential bands over the surface of the filament, extending perpendicular to the filament axis. At 10,000× magnification, these bands are visible as interruptions in striations extending in the direction of the filament axis, i.e. the striations become less visible and even disappear as they enter the bands extending perpendicular to the filament axis. Thus, the circumferential bands visible at 3000× magnification arise from alternating regions of striated surface structure and smoother surface structure wherein striations are diminished or not present. When the melt spinning temperature is maintained at 350° C. and the draw ratio is reduced to produce a yam having a tenacity of 2.4 g/den, no banding is visible at 3000× scanning electron microscope magnification. Nevertheless, filament of this yam exhibits a finer surface texture at 25,000× magnification, with less indication of longitudinal striations, than filament from the same yarn, but melt spun at 335° C. and drawn to a tenacity of 2.4 g/den.

The yams of the present invention, whether monofilament or multifilament, exhibit high uniformity, uniformity being characterized by a coefficient of variation of total yarn denier of no greater than 5%, usually less than 2%. Coefficient of variation is the standard deviation divided by the mean weight of 5 consecutive ten meter lengths of the yam (X 100)(cut and weigh method). This high uniformity of yarn of the present invention enables the yam to be easily machine handled for the particular application of the yam. Yam of the present invention generally has a high tenacity, whether monofilament or multifilament, especially in the case of ETFE yam, wherein the tenacity is at least 2 g/d. At high spin speeds, higher tenacities can be achieved by drawing off-line, wherein lower wind-up speeds can be employed. Preferably, however, the desired tenacity is obtained by drawing-in line at high speeds such as at least 500 m/min and preferably at least 1000 m/min. The yams of the present invention, whether monofilament or multifilament, can also exhibit high elongation, i.e., elongation of at least 15%, and the ETFE yam in particular can exhibit the combination of tenacity of at least 2 g/d and elongation of at least 15%. The elongation of 15% enables the yam to be further processed and used thereafter without brittle breakage. For many applications, however, an elongation of at least 8% is sufficient, especially if the diameter of the filament is increased to thereby increase individual filament breaking strength. Preferably, the ETFE yarn of the present invention, whether monofilament or multifilament has a tenacity of at least 2.4 g/d, more preferably at least 3 g/den, and even more preferably at least 3.2 g/den. The deniers disclosed herein are determined in accordance with the procedure disclosed in ASTM D 1577, and the tensile properties disclosed herein (tenacity, elongation, and modulus) are determined in accordance with the procedure disclosed in ASTM 2256.

Another physical property measure of the quality of the yam is the "tensile quality" of the yam, as described in A. J. Rosenthal, "TE $^{1}/_{2}$An Index for Relating Fiber Tenacity and Elongation", Textile Research Journal, 36 No. 7, pp. 593–602 (1966). Tensile quality takes both tenacity (T) and elongation (E) into account as $T \times E^{1/2}$. The tensile quality of the yam of the present invention is preferably at least about 8, and even more preferably, at least about 9, and even more preferably, at least about 10.

As used herein "shear rate" refers to the apparent wall shear rate, calculated as $4Q/\pi R^3$ (Q=volumetric flow rate, R=capillary radius). In the process of the present invention, the shear rate is at least 100/sec, preferably at least 500/sec. The shear rate range over which satisfactory fiber melt-spinning can be achieved in a given configuration and at a given temperature grows progressively narrower with increasing polymer melt viscosity. The operating window can be expanded by increasing the temperature which displaces the critical shear rate for the onset of melt fracture to higher rates, but care must be taken to avoid polymer degradation. The critical temperature and shear rate for melt fracture is determined herein by increasing the throughput rate for a given temperature and die dimension until surface roughness is visible as shown by the change in molten extrudate from a transparent to a slightly opaqueness indicating the onset of melt fracture. Further increase in throughput rate would give an undesirable coarser surface roughness and poorer spinning performance and properties.

The spinning speed of the process of the present invention is at east 500 m/min and is determined herein as the spinning speed (at the surface) at the last roll, which depending on the configuration of the melt-spinning apparatus may be a take-up roll or may be a wind-up roll (or last draw roll if no windup roll is used).

It is found in the practice of the present invention that both shear rate and SSF (spin-stretch factor) have a large effect on the strength of the spun filament. The same strength can be maintained as the shear rate increases while the SSF decreases and vice versa as demonstrated in Example 1 and shown graphically in FIG. 11.

Figure 14:
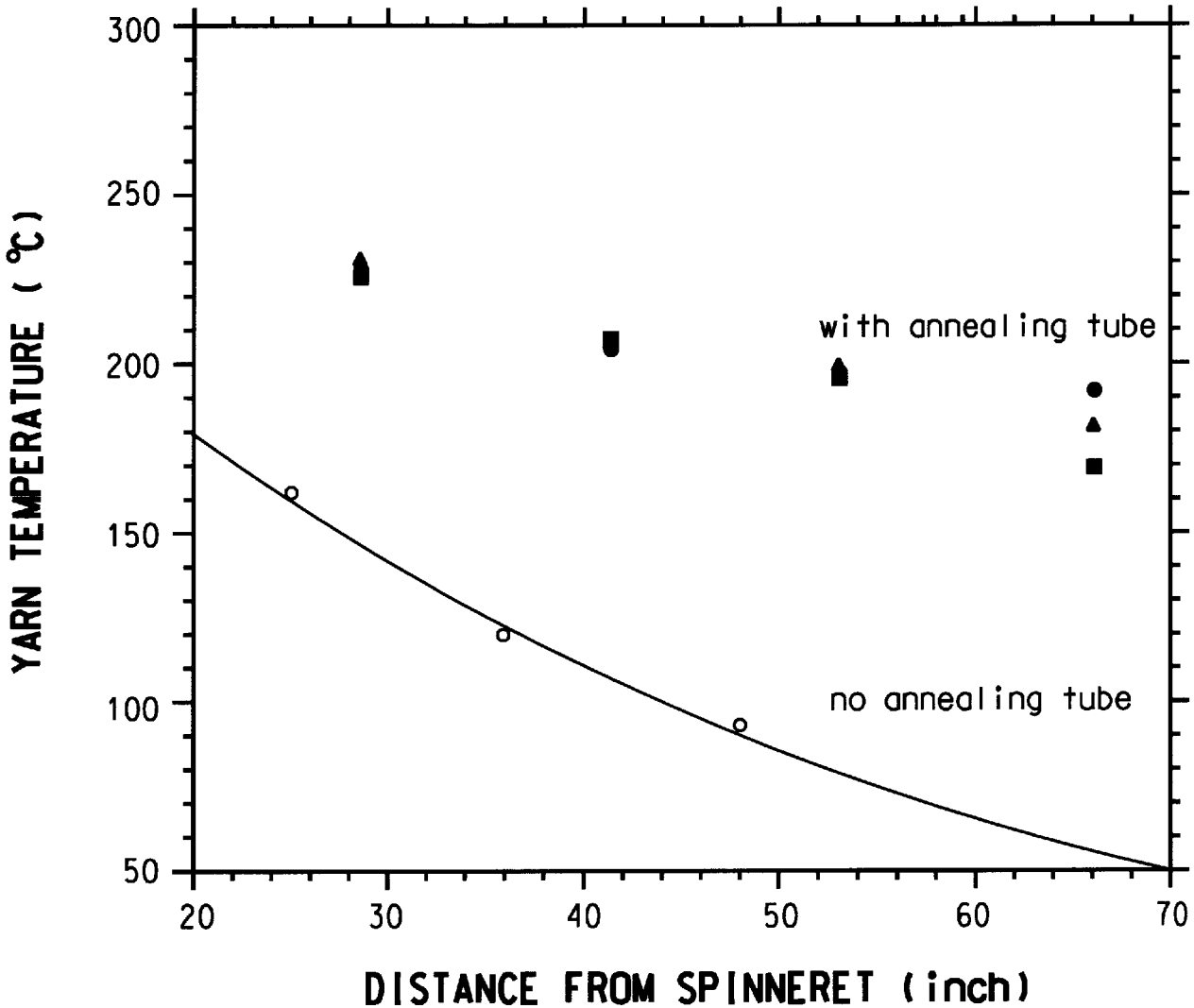
FIG. 14 is a graphical representation of distance from a spinneret (inch) vs. yam temperature with an annealer (darkened symbols) and without an annealer (open symbols) using Teflon® FEP-5100, a 39.4-mil/30-filament spinneret, a spinneret temperature of 480° C., at 45.4 gpm/6.0 pph, wherein the square represents the yam temperature at a spinning speed of 400 mpm, the circle represents the yam temperature at 500 mpm, and the triangle represents the yam temperature at 700 mpm.
Figure 15:
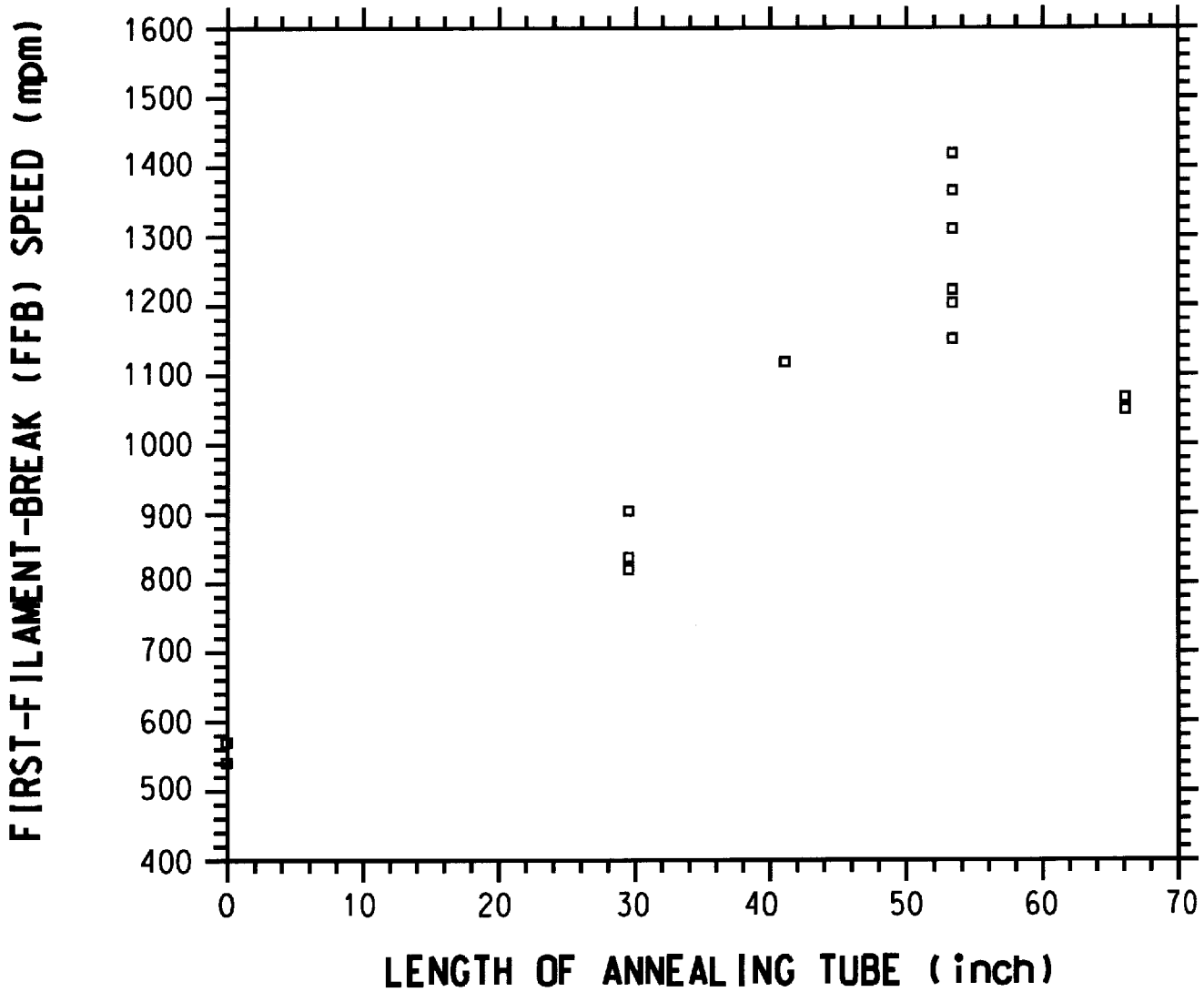
FIG. 15 is a graphical representation of length of annealer (inch) vs. first-filament-break speed in meters/minute (mpm). The following were used: Teflon® FEP-5100 fluoropolymer, a 30-mil/30-filament spinneret, a spinneret temperature of 480° C., and 44.8 grams/minute (gpm).

The process of the present invention can further comprise shielding the one or more filaments being melt spun, preferably a plurality of filaments. By shielding the filaments, the air surrounding the filaments remains warmer than if the filaments were exposed to unrestricted ambient air and thus prevents rapid cooling of the filaments. Unrestricted ambient air, and in particular, turbulent air can result in rapid cooling of the filaments which is undesirable because it can be detrimental to the amount of draw the filament may have. Thus, shielding the molten filament(s) involves both the shielding of the filament(s) from turbulent air and delays their solidification, with the solidification resulting from cooling with quiescent air, i.e. non-turbulent, whereby the cooling is uniform with respect to individual filaments and from filament to filament, thereby permitting higher attenuation of spin stretch (SSF). SSF is well known to be the velocity of the first roll in the melt spinning process that exerts a pulling force (stretch) on the molten threadline divided by the mean velocity of the polymer flowing through the die orifice (aperture), and that the mean velocity of the polymer flow is the orifice throughput divided by the orifice area. It has been observed herein that the achievement of high SSF for high spinning can be obtained if the solidification of the molten threadline occurs at a distance greater than 50 times the diameter of the extrusion die (capillary diameter) (see also FIG. 13) through which the filament(s) are melt spun. Preferably, the solidification distance is greater than 500 times the diameter of the capillary diameter. Solidification of the molten threadline is indicated visually by the appearance of the filament changing from being translucent to opaque. Shielding can be accomplished by running the molten filaments through an annealer. An annealer permits the high speed extruded molten filaments to be spin stretched to a high degree and thus increases the spinning speed. Although a gentle suction of air can be generated by the fast moving yarn through the bottom of the annealer, the annealer still provides a relatively quiescent environment against surrounding air turbulence which partially cools but prevents rapid cooling of the extremely hot molten filaments, maintaining the filaments above their melting point for a much further distance from the spinneret than without an annealer. Thus, the shielding results in the delayed but uniform cooling of the filaments to cause them to solidify. This is shown graphically in FIG. 13. The use of an annealer also maintains the solidified yam at a higher temperature than without the use of an annealer as shown in FIG. 14. In addition, the use of an annealer can permit higher spinning speeds as shown in FIG. 15 (note: 0-inch represents no annealer).

Figure 10A:
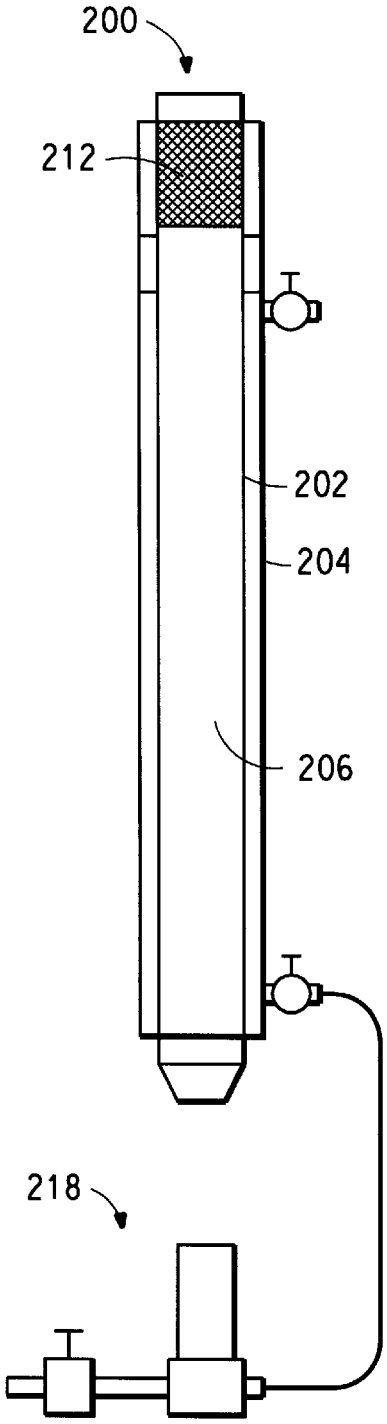
FIGS. 10A and 10B are cross-sectional views of one embodiment of an annealer useful in the present invention.
Figure 10B:
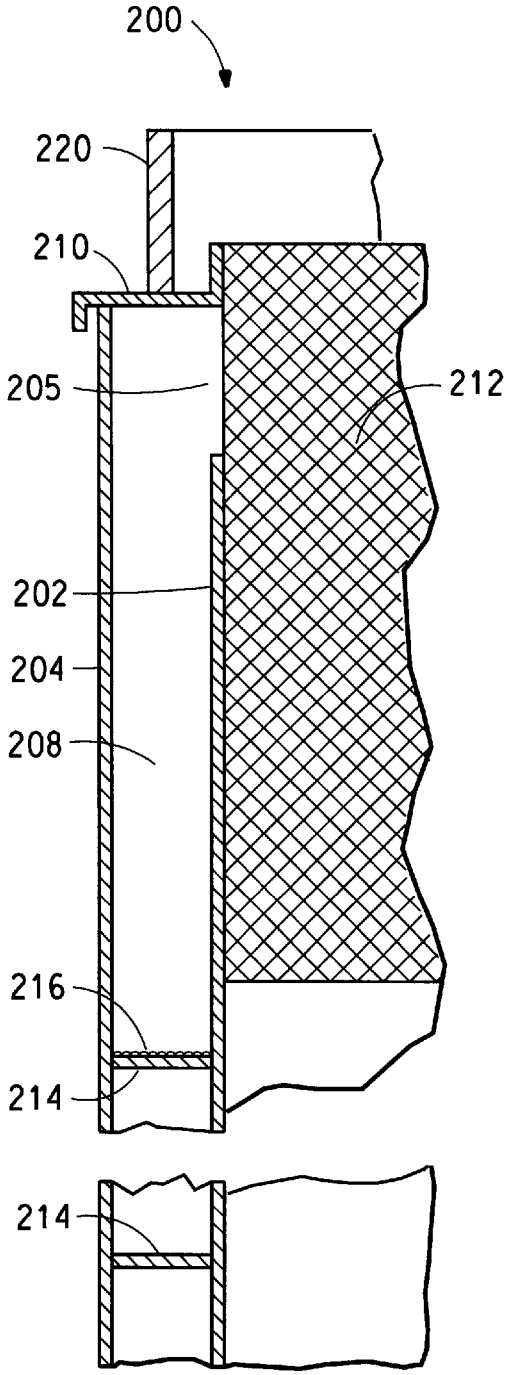

One embodiment of an annealer useful in the present invention is shown in FIGS. 10A and 10B. As shown, annealer 200 includes inner tube 202 which is a long tube concentrically disposed inside outer tube 204, a slightly larger diameter tube which can be of substantially the same length. inner tube 202 can be positioned within outer tube 204 to extend below outer tube 204 and thus provides an exit for the molten filaments and further creates a cylindrical opening 205 at the top of outer tube 204. Opening 205 permits air to be sucked into inner chamber 206 of inner tube 202 which may have been pre-heated in annular space 208 between inner tube 202 and outer tube 204. Although external heat is not provided, annular space 208 can be heated during spinning by the heat radiating from the extruded hot molten filaments. Top flange 210, which can have a circular peripheral lip, sits on top of outer tube 204. Mesh tubing 212, preferably composed of a fine mesh screen, such as 20-mesh, can be attached to top flange 210 and is disposed adjacent the inner walls of inner tube 202. Mesh tubing 212 extends axially through inner chamber 206 beyond opening 205, but it is not necessary to provide the mesh tubing for the entire length of the inner tube. Mesh tubing 212, which can further include a second finer mesh, such as 100-mesh, attached to or in close proximity to the first mesh, serves to reduce incoming air turbulence and also facilitates a substantially uniform distribution of the air so that the air travels radially into inner chamber 206 through opening 205. There is also shown perforated annular plate spacers 214, disposed between inner tube 202 and outer tube 204, and connected either to the outer surface of inner tube 202 or to the inner surface of outer tube 204, and can serve to prevent inner tube 202 from falling out of outer tube 204. Screens 216 of fine mesh can be placed on top of plate 214 to diffuse and distribute the air traveling up and into opening 205. Such spacers 214 and 216 are optional. An optional glass ring 220 permits visual observation of the molten threadlines and spinneret face.

The inner and outer tubes of the annealer can be fabricated from materials including metal, such as aluminum, or plastic, such as Lucite®. The annealer can be self-standing or held stable with a suitable mounting mechanism which can be attached to other elements of a melt spinning apparatus or affixed to other materials to keep it held steady.

The process of the present invention can further comprise passing the extrudate in the form of one or more strands through a quench zone to means for accumulating the spun fiber. The quench zone may be at ambient temperature, or heated or cooled with respect thereto, depending upon the requirement of the particular process configuration employed.

Any means for accumulating the fiber is suitable for the practice of the present invention. Such means include a rotating drum, a piddler, or a wind-up, preferably with a traverse, all of which are known in the art. Other means include a process of chopping or cutting the continuous spun-drawn fiber for the purpose of producing a staple fiber tow or a fibrid. Still other means include a direct on-line incorporation of the spun-drawn fiber into a fabric structure or a composite structure. One means found suitable in the embodiments here in below described is a textile type wind-up, of the sort commercially available from Leesona Co., Burlington, N.C.

Such other means as are known in the art of fiber spinning to assist in conveying the fiber may be employed as warranted. These means include the use of guide pulleys, take-up rolls, air bars, separators and the like.

An anti-static finish can be applied to the fiber. Such finish application is well known in the trade.

The process of the present invention can further comprise drawing the fiber, a relaxing stage, or both. The fiber can be drawn between take-up rolls and a set of draw-rolls. Such drawing is well known in the trade to increase the fiber tenacity and decrease the linear density. The take-up rolls may be heated to impart a higher degree of draw to the fiber, the temperature and the degree of draw depending on the desired final fiber properties. Likewise additional steps, known to those of ordinary skill in the art, may be added to the present process to relax the fiber. A spinning speed of at least about 500 m/min established by the draw rolls is desired, with at least about 1000 m/min being preferred, more preferably at least about 1500 m/min. The draw at temperatures below the melting point of the polymer, to longitudinally orient the crystals of the polymer, will generally be between 1.1:1 to 4:1, preferably at least 3:1, i.e. a draw ratio of at least about 3.

The present invention also provides a second process for melt spinning a composition comprising polytetrafluoroethylene homopolymer, comprising the steps of melting a composition comprising a polytetrafluoroethylene homopolymer to form a molten polytetrafluoroethylene composition; conveying said molten polytetrafluoroethylene composition under pressure to an extrusion die of an apparatus for melt spinning; and extruding the molten polytetrafluoroethylene composition through the extrusion die to form molten filaments.

In the method of melt spinning the homopolymer, polytetrafluoroethylene (PTFE), preferred PTFE homopolymers are those that give a melt flow at temperatures below 480° C. Preferred homopolymers include Zonyl® fluoro-additives, which are also known as micropowder, i.e. low molecular weight PTFE, PTFE granular molding powder grades, such as Teflon® PTFE TE-6472, and PTFE lubricated paste extrusion resins, such as Teflon® PTFE 62, all available from E. I. du Pont de Nemours and Co., Wilmington, Del. Because of the extreme temperatures required to exhibit melt flow characteristics which border on the verge of thermal degradation, the present process is of particular importance in the successful melt processing and fiber spinning of PTFE homopolymers.

The description above pertaining to the steps in the first process of melt spinning the highly fluorinated thermoplastic composition and the apparatus useful therefor are applicable to the process of melt spinning the polytetrafluoroethylene composition. However, the same limitations on extrusion die temperature or shear rate or spinning speed found in the first process may not be applicable in the present PTFE process.

Preferably, the temperature of the extrusion die is at least 450° C. The. spinning speed is preferably at least 50 mpm; more preferably at least 200 mpm; and most preferably at least 500 mpm.

The present invention further provides an apparatus for melt-spinning fibers comprising a spinneret assembly comprising means for filtering; a spinneret; an elongated transfer line, said transfer line being disposed between said filtration means and said spinneret; means for heating said elongated transfer line; means for heating said spinneret; and an elongated annealer disposed beneath said spinneret assembly, the annealer shielding the molten filaments from turbulent cooling air while permitting the molten filaments to be cooled by contact with air (non-turbulent), resulting in the uniform cooling of the molten filaments and delay in their solidification, as described above.

Any means for filtering melt-spun fiber conventionally used in the art for melt-spinning can be used in the present apparatus. The spinneret is constructed to allow separate heating of the face of the spinneret, i.e., the portion of the spinneret which includes the walls of the capillaries, which face may comprise a separate plate or be integral part of the body of the spinneret, from other areas of the melt-spinning apparatus. The length to diameter ratio of the capillaries within the spinneret are preferably about 1:1 to about 8:1. The capillary holes of the spinneret are preferably a plurality thereof arranged to achieve uniform heating among all of the holes. Preferably, the capillary holes are arranged in two concentric circles or in one circle. Preferably the spinneret is separately removable from the transfer line to allow easy cleaning or replacement. Likewise, the transfer line is preferably removable from the filter pack and the spinneret. Means for heating the transfer line and means for heating the spinneret can include a band heater, a coil heater, or other conduction, convection or induction heaters known to those of skill in the art.

The elongated annealer, described in more detail above and in the examples, preferably comprises an inner tube and an outer tube separated by an annular space. Preferably the inside diameter of the inner tubes ranges from about 3-inches to about 8-inches. The elongated annealer can further comprise a mesh tube disposed adjacent the inner wall of the inner tube extending at least partially down the length of the inner tube. The elongated annealer can further comprise at least one perforated plate disposed within the annular space, extending radially with respect to the circumference of said outer tube, and attached to the outer wall of said inner tube, the inner wall of said outer tube, or to both tubes.

Screens may be positioned on or in close proximity to these perforated plates. Air can enter the annular space of the annealer through an opening or port. The annealer can further comprise means for measuring or controlling the air flow rate, such as via a needle valve or a flow meter.

The present apparatus can further comprise means for accumulating the spun filaments. Any means conventionally known in the art can be used, including but not limited to, a take-up roll, a draw-roll, and a wind-up roll.

Figure 9:
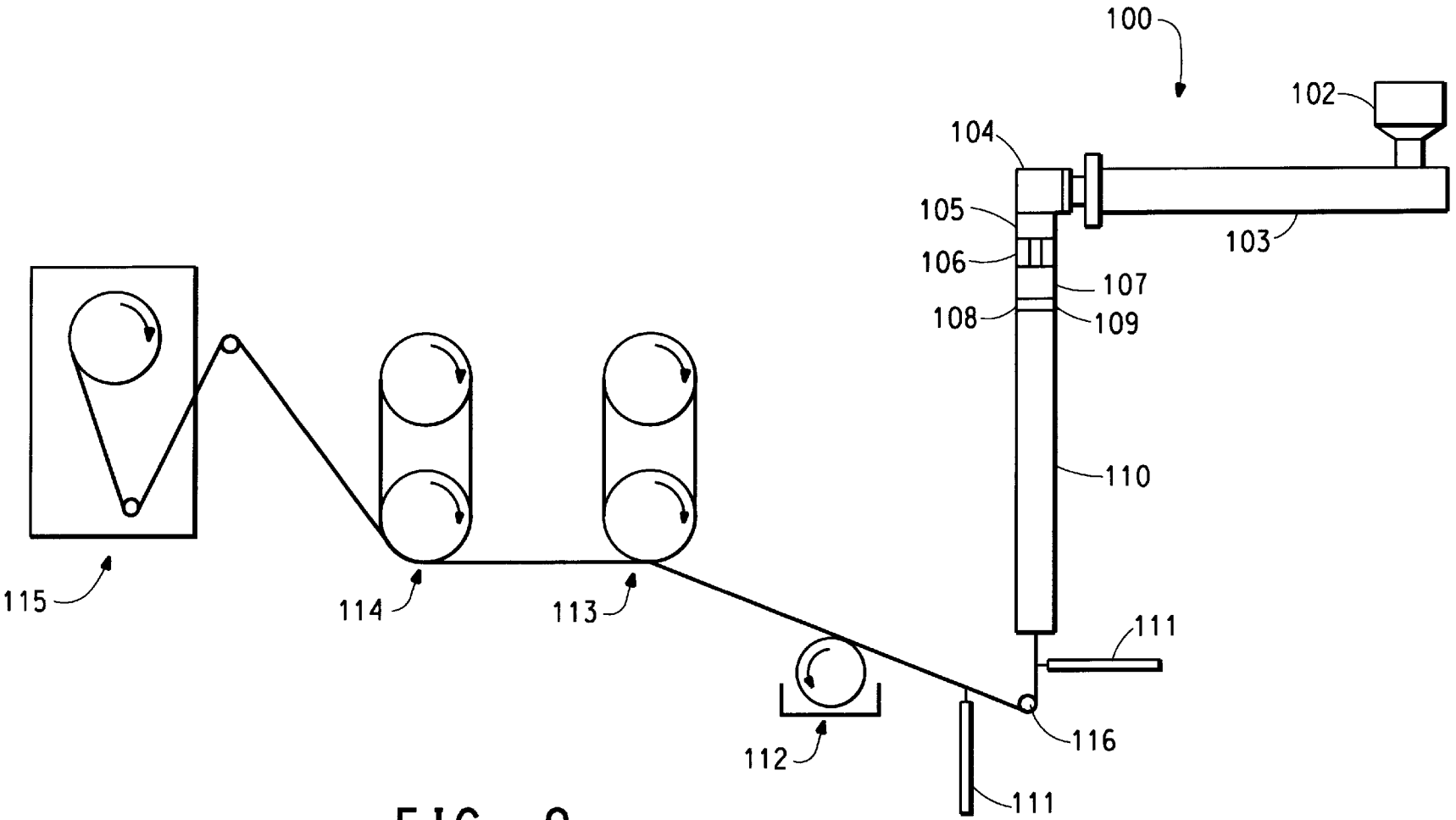
FIG. 9 is a schematic of one embodiment of a melt spinning apparatus of the present invention.

One embodiment of an apparatus of the present invention for melt-spinning is shown, as melt spinning apparatus 100 in FIG. 9. Shown are feed hopper 102 into which the polymer composition is fed, preferably in the form of pellets. These pellets are heated and conveyed through screw extruder 103. After the polymer or blend composition is melted, it is conveyed under pressure to pump block 104, through filter pack 105, transfer line 106 to spinneret 107 having face 108. Glass sleeve 109 permits viewing of the molten filaments. Molten fluoropolymer composition is extruded through one or more apertures of face plate 108 in spinneret 107 to form a continuous strand which is directed through elongated annealer 110 wherein the strand is shielded to prevent rapid cooling. Upon leaving the annealer, the spun fiber travels through pigtail guides 111, change of direction guides 116 to kiss roll 112 for an optional finish application, to a pair of take-up rolls 113, a pair of draw rolls 114, and a windup 115. Additional draw rolls may be added as well as relaxation rolls.

Fibers made by the process and apparatus of the present invention can be useful in textiles. Such textiles can be used in high performance sporting apparel, such as socks. Such fibers can be combined with other fibers in fabrics. Fibers of PTFE can be used for industrial quality yam for wet filtration. PTFE fiber can also be chopped for dry lubricant bearings. Such staple fiber can be used in that form or in such other form as felt of staple fiber yam. Felt can also be made from staple fiber of highly fluorinated thermoplastic polymer. The yam of the present invention can be monofilament or multifilament, and the melt spinning holes in the spinneret faceplate forming the filaments will generally have a diameter of less than 2000 micrometers. When the yam is a monofilament, it will generally have a diameter of 50 to 1000 micrometers. When the yam is multifilament, the individual filaments will generally have a diameter of 8 to 30 micrometers, and the yarn will generally have a denier of 30 to 5000, preferably 100–1000 and contain 20 to 200 filaments. In the case of the multifilament yam, the individual filaments will preferably each be 2 to 50 den, preferably 5 to 40 den/filament, and most preferably 10–30 den/filament, with 20–30 den/filament being preferred for highest breaking strength without undue stiffness. The melt spinning holes in the faceplate are preferably circular to produce filaments having an oval, preferably circular, cross-section, free of sharp edges.

The multifilament yam of the present invention will normally be twisted by conventional means for yam integrity, e.g. 1 to 2 twists per cm, and a plurality of said yams will be plied or braided together to form such articles as sewing thread, dental floss, and fishing line when the yarn has the strength required for these utilities. ETFE yam (multifilament and monofilament) has both high strength and high elongation. To form sewing thread, generally 2–4 yams of the present invention will be plied together and heat set to form sewing thread having a denier of 800 to 1500. To form dental floss, yam of the present invention can be plied or braided together to form dental floss having a denier of 800 to 2500. Monofilaments and multifilament yam of the present invention can be used as fishing line. Such monofilaments will typically have a diameter of 0.12 mm (120 micrometers) to 2.4 mm (2400 micrometers). Such multifilament yam will generally be braided from 4 to 8 yams of the present invention, each having a denier of 200 to 600.

Colorant can be added to the copolymer prior to yam formation, so that the yam will have color, which is especially desirable for many sewing thread, fishing line and dental floss applications. The yam of the present invention and the products made therefrom, e.g. sewing thread, dental floss, fishing line and fish netting, exhibit excellent chemical and weathering (including UV radiation) resistance, making them especially useful in these applications and other applications requiring exposure to weather and chemicals. The yarn is useful to make woven and knitted fabrics made entirely of such yam or blended with yam of other materials Examples of such fabrics include architectural fabrics, fabrics for reinforcement of printed circuit boards and electrical insulation, and for filtration applications.

EXAMPLES

In the examples the following polymers (all available from E. I. du Pont de Nemours and Company, Wilmington, Del.) were used:

Teflon® PFA 340, a copolymer of TFE and perfluoropropyl vinyl ether

Teflon® FEP 5100, a copolymer of TFE, hexafluoropropylene, and perfluoroethyl vinyl ether Zonyl® MP-1300 PTFE Teflon® TE-6462 PTFE Teflon® PTFE TE-6472, a granular molding powder Teflon® PTFE 62, a lubricated paste extrusion resin Zonyl® MP-1600N, PTFE Unless otherwise indicated, the polymer used was Teflon® PFA 340.

Example 1

The effects of spinneret temperature, shear rate and spin stretch factor (SSF) on spinning speed and fiber properties were tested.

Spinning was conducted using a 1.0-inch diameter steel single screw extruder, to which was connected a spin pump block, which was in turn connected to a spinneret pack adapter with the following features: a by-pass plate was used in place of a spin pump. An elongated spinneret was used, such as is depicted in FIG. 2, wherein "h" was 2.0 in. A 30-mil 39-hole spinneret, wherein all of the holes were in only one circle, was used to cover the shear rate from low to medium shear rates, e.g. about 60/sec to about 180/sec, while a 15-mil 25-hole spinneret was used to cover the medium to high shear rates, e.g. about 350/sec to about 1,150/sec. A 1-inch high, 1.25-inch inside diameter coil heater (Industrial Heater Corp.) was wrapped around the lower 1-inch part of the elongated spinneret and was used to separately heat a portion of the spinneret that included the face plate. Conventional take-up rolls were used along with a Leesona wind-up.

The temperature profile prior to the spinneret was 350° C. in the screw extruder, 380° C. in the pump block to the pack filter located between the extruder and the spinneret. Three spinning operations were performed using Teflon® PFA 340. The spinneret temperature was set at 420° C., 460° C., or 500° C.

At 420° C. melt fracture (M.F.) occurred at about 180/sec shear rate. The highest possible spinning speed with all filaments intact without melt fracture was slightly less than 219 mpm at a shear rate of about 90/sec. The fiber tenacity at this speed and shear was 1.02 gpd. The highest spinning speed at last filament break was 490 mpm at a shear rate of about 60/sec, and the fiber tenacity was 1.68 gpd with a filament denier of 4.0.

At 460° C. the spinnable shear rate increased to slightly less than 720/sec before the onset of melt fracture. The highest measured spinning speed at first filament break was 435 mpm at a shear rate of 160/sec, and the fiber possessed a tenacity of 1.13 gpd. The highest spinning speed at last filament break was 850 mpm also at a shear rate of about 160/sec. The highest fiber tenacity for fiber spun to last filament break was 1.61 gpd spun at 580 mpm with a filament denier of 2.0.

Figure 11:
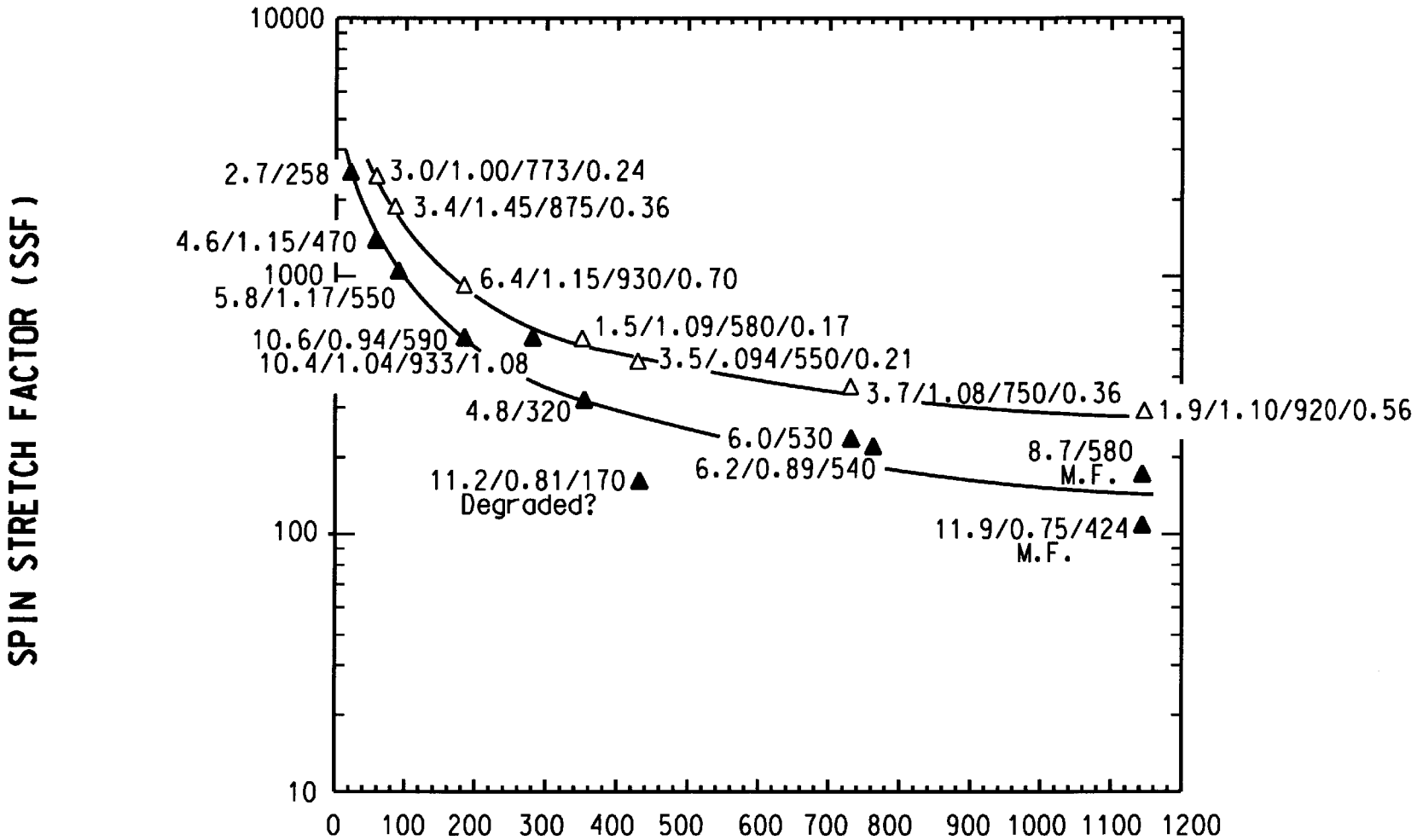
FIG. 11 is a graph plotting shear rate (1/sec) vs. SSF at 500° C. for a composition of Example 1, wherein the darkened triangle represents the spin stretch factor (SSF) at first filament break and the open triangle represents the SSF at the last filament break. Included is some data for denier/tenacity/speed/gpm.

A graph of shear rate vs. spin stretch factor for the 500° C. spinneret sample is shown in FIG. 11. The darkened triangle represents data at first filament break and the open triangle is data at last filament break. At 500° C., the spinnable shear rate was pushed to slightly less than 1,150/sec before the onset of melt fracture. The highest spinning speed at first filament break was 933 mpm at a shear rate of about 180/sec, and the fiber possessed a tenacity of 1.04 gpd. The highest spinning speed at last filament break was 930 mpm also about 180/sec, and the tenacity at this speed was of 1.15 gpd.

Thus, it is seen that as the temperature of spinneret increased from 420° C. to 500° C., the attainable spinning speed increased by a factor of 4.3×.

Figure 12:
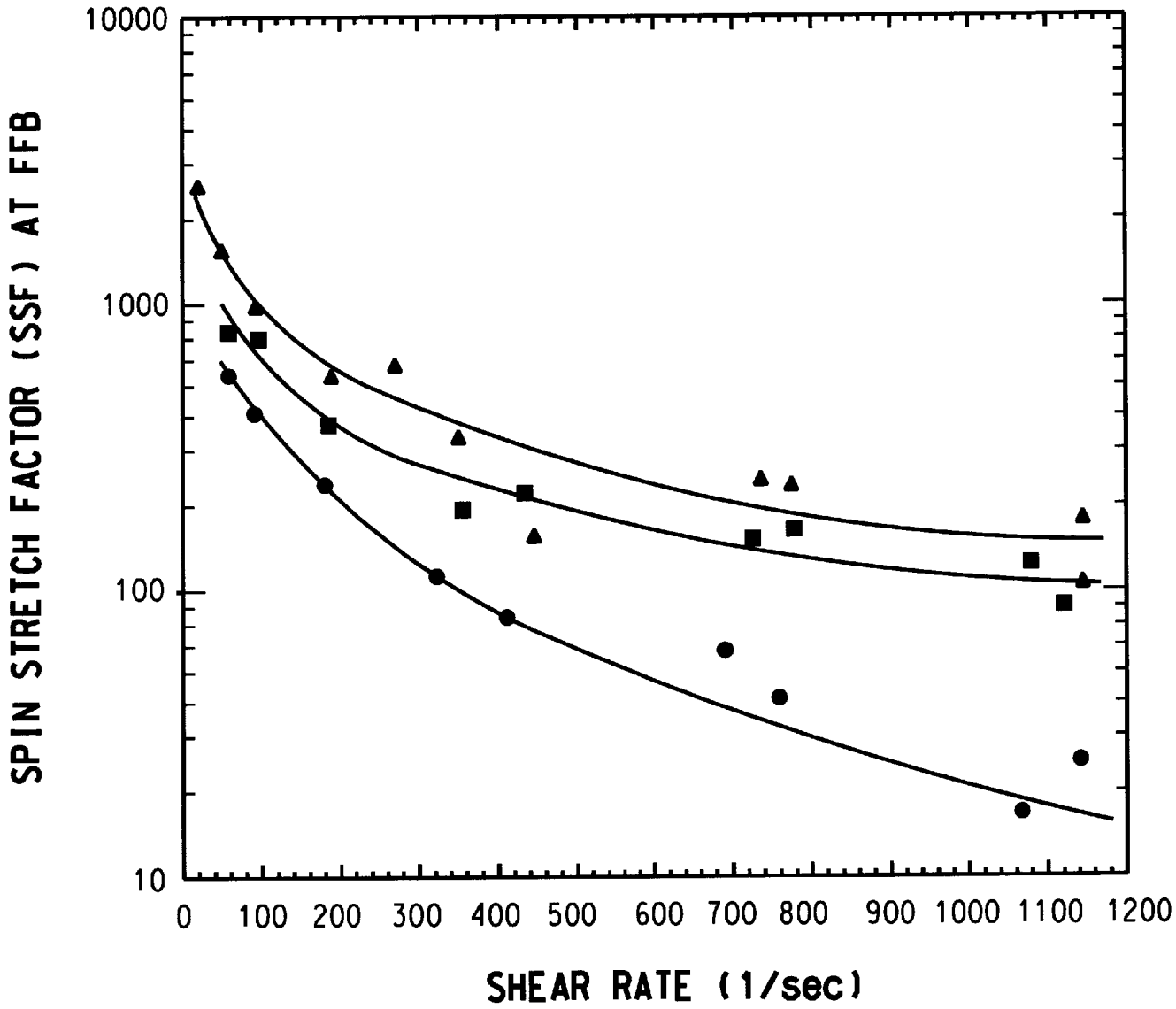
FIG. 12 is a graph demonstrating that temperature exerts a positive effect on SSF at first filament break at constant shear rate. The 15 circle represents SSF at 420° C.; the square represents SSF at 460° C.; and the triangle represents SSF at 500° C. (see also Example 1).

Temperature also exerted a positive effect on the SSF at first filament break at constant shear rate, as shown in FIG. 12. The darkened circles show SSF at 420° C.; the darkened squares show SSF at 460° C.; and the darkened triangles show SSF at 500° C. A higher SSF meant that at the same throughput rate and given spinneret hole size, the take-up roll speed was higher in spinning speed. Unless otherwise stated in the remaining examples, spinning was conducted using the equipment described above except that a 1.5-inch diameter corrosion resistant single screw extruder, made by Killion Extruders, Inc., Cedar Grove, N.J., was used. This extruder had three separate heating zones designated "Screw Zone 1, 2 and 3" in the temperature profiles below. A clamp ring was used to attach the extruder to a screw adapter holding them together, and the screw adapter was, in turn, attached to a spinneret adapter. The clamp ring was heated using a cylindrical rod cartridge heater, and the screw adapter and spinneret adapters were heated using cartridge heaters. A band heater was used to heat the filter pack. Unless otherwise indicated, a band or coil heater was used for heating any transfer line present, and the spinneret face. Conventional take-up and wind-up equipment was used, including a Leesona wind-up. The length-to-diameter ratio of the spinneret capillaries (die orifices) used in the Examples is 3:1 unless otherwise indicated.

Example 2

Spinning was conducted at a throughput rate of 1.3 grams per minute per hole using a 30-mil 30-hole elongated spinneret at a jet velocity of 1.9 mpm. The equipment spinning temperature (° C.) profile was:

| Screw Zones | Clamp Ring | Screw Adapter | Spinneret Adapter | Pack Filter | Spinneret |
|---|---|---|---|---|---|
| 1, 2, 3 All 350 | 380 | 353 | 480 | 480 | 500 |

The shear rate was 328/sec, and the maximum spinning speed achieved was 1,100 mpm for a spin-stretch factor at first filament break (FFB) of 580. The denier, tenacity, elongation, and modulus of the resultant fibers were, respectively: 11 d/0.76 gpd/61%/5.6 gpd.

Example 3

This spin was done similar to Example 2 except that a 5-foot tall tapered aluminum annealer was added to the equipment downstream of the spinneret to shield the molten filaments after their exit from the spinneret. The annealer had a square cross section, 12-inch square at the top and tapering down to a 1.0-inch square at the bottom. The same temperature profile was used as in Example 2 except for the following changes: 380° C. screw adapter, 470° C. spinneret adapter, 470° C. pack filter. The shear rate was 328/sec. At the same throughput rate of 1.3 grams per minute per hole and using the same 30-mil, 30-hole elongated spinneret as was used in Example 2, the maximum spinning speed increased by 35%, or 385 mpm to 1,485 mpm, for a SSF at FFB of 782.

The denier, tenacity, elongation and modulus of the resultant fibers were, respectively: 9.4 d/0.72 gpd/76%/5.1 gpd.

Example 4

This spin was done similar to Examples 2 and 3 except that a different annealer was used. For this spin, a 6-ft 3-in high self-standing Lucite® annealer was used which had a 12-in×12-in square cross section. The same temperature profile was used as in Example 3. The shear rate was 328/sec. The maximum spinning speed was increased to 1,756 mpm for a SSF at FFB of 924. This was a 60% increase in spinning speed compared to Example 2, or an 18% increase in spinning speed compared to Example 3. The denier, tenacity, elongation and modulus of the resultant fibers were respectively: 6.0 d/1.16 gpd/28%/10 gpd.

Example 5

A spinneret assembly, such as shown in FIG. 3, having a shortened elongated spinneret was used in this example. The distance between the bottom face of the filter pack and the face plate of the spinneret was 1.25-inch. The same temperature profile and the same 6-ft 3-in Lucite® annealer was used as in Example 4. The shear rate was 328/sec. The maximum spinning speed achieved was 1,860 mpm for a SSF at FFB of 979. This high speed sample was not tested for fiber properties, but another sample spun under the same conditions at a shear rate of 342/sec with a spinning speed of 1,701 mpm had fiber properties (denier, tenacity, elongation and modulus, respectively) of: 7.6 d/1.01 gpd/68%/6.2 gpd.

Example 6

Spinning was conducted as in Example 5, except that the shortened elongated spinneret was heated using an induction heating coil, and the following changes in the temperature profile were used: 440° C. pack filter, 522–531° C. spinneret. The shear rate was 342/sec. The maximum spinning speed at FFB was 1,860 mpm. The denier, tenacity, elongation and modulus of the resultant fibers were, respectively: 9.6 d/1.06 gpd/49%/8.7 gpd.

Example 7

Spinning was conducted as in Example 6, except that the annealer used was the same tapered aluminum annealer used in Example 3. A 12-in cube clear Lucite® box was added on top on the annealer for the purpose of viewing the threadlines. The shear rate was 342/sec. The maximum spinning speed at FFB was 1,860 mpm. The denier, tenacity, elongation and modulus of the resultant fibers were, respectively: 9.0 d/1.02 gpd/54%/7.7 gpd.

Example 8

Spinning was conducted using a spinneret, such as is shown in FIG. 4, having a cartridge heater (available from Industrial Heater Corp. Strafford, Conn.) in the center of the spinneret and a standard band heater on the outside of the spinneret. The length of the spinneret from the bottom face of the filter pack to the face plate of the spinneret was 1.25-inch. The temperature profile used was:

| Screw Zones | Clamp Ring | Screw Adapter | Spinneret Adapter | Pack Filter | Spinneret Center | Spinneret |
|---|---|---|---|---|---|---|
| 1, 2, 3 All 350 | 380 | 380 | 411 | 410 | 496 | 500 |

The spinneret used had 26holes; however, the throughput per hole was kept constant as in Examples 2 to 7. Thus, the shear rate was about the same, i.e. 342/sec. The maximum spinning speed was 1,976 mpm for a SSF of 1,040. The 6% increase in speed compared to Example 5 was attributed to the more uniform heating of the melt across the spinneret. The fiber properties of denier, tenacity, elongation and modulus were, respectively: 5.6 d/1.09 gpd/55%/7.0 gpd.

Another sample spun with a 400° C. temperature in the spinneret adapter and pack filter and the same 500° C. in the spinneret gave a maximum speed of 1,920 mpm for a SSF of 1,010. Fiber tenacity was higher with the fiber properties of denier, tenacity, elongation and modulus measured as follows: 5.6 d/1.25 gpd/54%/8.7 gpd.

Example 9

A spinneret assembly, such as is shown in FIG. 6, was used to test the effectiveness of this embodiment in achieving high spinning speed. A 15-hole 1.0 in diameter disc spinneret with 30-mil diameter holes was used. The annealer used was the 6-ft 3-in Lucite® annealer used in Example 4. A band heater was used for the pack filter. The transfer line measured from the bottom face of the filter pack to the spinneret disc was 3.125-inch.

At a screw rpm of 4.0, the total throughput rate was 20.3 grams per minute (2.7 lbs/hr) or 1.35 gpm per hole. This is substantially the same throughput rate per hole for the previous examples. A spinning speed of 1,816 mpm was achieved with all filaments intact under the following conditions: the screw extruder temperature was set at 350° C. in all three zones; the clamp ring and the screw adapter were set at 380° C. for a measured melt temperature of 389° C.; the spinneret adapter and pack filter were set at 430° C.; the transfer line was set at 470° C.; and the spinneret was set at 500° C.

Decreasing the temperature of the spinneret adapter and pack filter and increasing the transfer line temperature further improved the spinning speed:

| Spinneret Adapter and Pack Filter | Transfer Line | Spinneret | Maximum Speed mpm | Properties Den/Ten/E/Mod |
|---|---|---|---|---|
| 430° C. | 474° C. | 500° C. | 1816 | 6.5/1.20/45%/10 |
| 420° C. | 471° C. | 500° C. | 1969 | 5.5/1.24/24%/12 |
| 410° C. | 471° C. | 500° C. | 1965 | 5.6/1.38/35%/13 |
| 400° C. | 470° C. | 500° C. | 1950 | 5.8/1.27/32%/12 |
| 400° C. | 480° C. | 500° C. | 1994 | 5.3/1.48/48%/12 |

A spinning speed of 1,994 mpm was achieved which was a 14% improvement from the spinning speed of 1,756 mpm in Example 4. The shear rate was 347/sec. Fiber tenacity improved by 28% from 1.16 gpd to 1.48 gpd. This improvement in strength was attributed, besides the higher speed, to a lesser or no polymer degradation.

Several samples of yam were collected at 1,000 mpm to test the long term stability of the spinning process. Filament spinning continuity was excellent allowing for a wind up of 60 minutes and 105 minutes with both voluntarily doffed. The fiber properties of denier/tenacity/elongation and modulus were: 11 d/0.94–1.01 gpd/68–80%/7.5 gpd, respectively.

A sample, spun at a speed of 1,500 mpm and lasting 4 minutes, had filament properties of denier/tenacity/elongation/modulus of 7.2 d/1.20 gpd/39%/11 gpd, respectively. Another sample, spun at 1,000 mpm and drawn in-line at 1.4× at 280° C. for an overall spinning speed of 1400 m/min, had the fiber properties of denier/tenacity/elongation/modulus of 7.6 d/1.41 gpd/25%/14 gpd, respectively.

Measurements made on air samples collected at the annealer exit, along the yam path above the heated take-up rolls, and above the wind-up did not detect any evolved gases. Thermal polymer degradation would have produced gases. Since evolved gases could also have been trapped or dissolved inside the fibers, the fibers were collected in vials and their head spaces, checked at various time intervals using infra-red spectroscopy, gas chromatograph/mass spectrometry, and ion chromatography, also did not contain any evolved gases. Additionally, the fiber samples were heated to 200° C. to release any dissolved gases, but none were detected. These results confirmed that in the present process, despite using temperatures as high as 500° C. to facilitate high shear rate, high spinning speed and high SSF, there was no polymer degradation. PFA polymer would have degraded easily if subjected to a temperature as low as 425° C. for more than 1.0 minute.

Example 10

This spin was similar to Example 9 except that an induction heater coil of about ⅛-in was wrapped twice around the face of the spinneret. The temperature profile in the screw extruder up to the screw adapter were kept the same as in Example 9. The shear rate was 347/sec. There was a 3.6% improvement in maximum spinning speed (from 1,994 mpm in Example 9) to 2,065 mpm for a SSF at FFB of 1,087. Maximum speed and properties obtained are shown below:

| Spinneret Adapter and Pack Filter | Transfer Line | Spinneret | Maximum Speed mpm | Properties Den/Ten/E/Mod |
|---|---|---|---|---|
| 430° C. | 470° C. | 520° C. | 1910 | 6.9/1.04/45%/6.5 |
| 400° C. | 480° C. | 525° C. | 2065 | 5.6/1.21/24%/11 |

Spinning continuity proved excellent when a sample was spun for 90 minutes at 997 mpm and voluntarily doffed. Fiber properties of denier/tenacity/elongation/ modulus were: 10.3 d/0.97 gpd/68%/3.6 gpd, respectively.

Example 11

A spinneret assembly, as shown in FIG. 8, was used. The spinneret face had a diameter of 1.75" and 60 holes of 30-mil diameter. Throughput rate per hole was 1.35 gpm for a total throughput of 81 gpm or 10.7 pounds per hour (pph). The tapered aluminum annealer with the 12-in cube Lucite® box on top of Example 7 was used. The temperature (° C.) profile used was:

| Screw Zones | Clamp Ring | Screw Adapter | Spinneret Adapter | Pack Filter | Transfer Line | Spinneret |
|---|---|---|---|---|---|---|
| 1, 2, 3 All 350 | 380 | 380 | 400 | 400 | 477 | 500 |

The maximum spinning speed was 1,359 mpm. The shear rate was 347/sec. The fiber properties of denier/tenacity/elongation/modulus were 8.0 d/1.04 gpd/67%/7.1 gpd, respectively.

The cause of the decrease in spinning speed, compared to the spinneret with 30 holes, such as in Example 7, was thought to be due to too much heat retention in the annealer due to the 2× higher total throughput. The annealer was replaced with the larger capacity 6-ft 3-in Lucite® box annealer, and the maximum spinning speed increased to 1,500 mpm. The temperature (° C.) profile used was:

| Screw Zones | Clamp Ring | Screw Adapter | Spinneret Adapter | Pack Filter | Transfer Line | Spinneret |
|---|---|---|---|---|---|---|
| 1, 2, 3 All 350 | 380 | 380 | 420 | 420 | 500 | 520 |

The fiber properties of denier/tenacity/elongation/modulus were: 7.2 d/1.20 gpd/48%/9.4 gpd.

In order to reduce excessive heat retention within the annealer, the annealer door, which ran lengthwise and nearly encompassed one side of the annealer, was opened full and covered with a perforated screen to provide quiescent air movement without turbulence. Using a perforated metal sheet with 3/32-inch diameter holes separated by 3/16-inch center-to center improved the maximum spinning speed by 8% to 1,623 mpm, compared to using the annealer with the door closed, using the slightly different temperature (° C.) profile:

| Screw Zones | Clamp Ring | Screw Adapter | Spinneret Adapter | Pack Filter | Transfer Line | Spinneret |
|---|---|---|---|---|---|---|
| 1, 2, 3 All 350 | 380 | 380 | 400 | 400 | 500 | 520 |

The fiber properties of denier/tenacity/elongation/modulus were 7.5 d/1.18 gpd/50%/8.9 gpd, respectively.

Some non-uniform air movement was observed in the perforated metal sheet covered front annealer, described above, because there was diffused air movement going in and out at the front while none at the other three sides. A thermocouple placed near the spinneret face showed the temperature fluctuating from 368° C. to 390° C. or a change of 22° C.

A larger Lucite® annealer was used which measured 20-in x 24-in cross-section and 71.5-inch in height with an opening at the top for the spinneret and at the bottom for access to threadline. During spinning, there was too much up and down air motion and the spinning speed was reduced.

Inserts were placed at the bottom of the annealer to reduce the 20-in x 24-in opening to a 20-in square. These inserts were tapered down so that the yam would fall out. The measured temperature fluctuation was still high at 25° C., but the actual temperatures were significantly cooler, 240° C. to 265° C. (Note: while the measured temperature was lower than in the smaller annealer, comparison between the absolute temperature between the two annealers should not be taken too exactly as the location of the thermocouple may not be exactly situated.) The air stability was visibly more quiescent. With the same temperature profile, the maximum spinning speed was improved and was slightly higher than that recorded for the smaller annealer: 1,680 mpm. The fiber properties of denier/tenacity/elongation/modulus were 8.2 d/0.84 gpd/59%15.9 gpd, respectively.

Example 12

With the preceding designs for an annealer there was some difficulty in reaching the yam at the bottom of the annealer in order to bring it to a sucker gun for stringing up the yam through all the yam processing path to the wind-up. In addition, annealing of the molten threadline depended entirely on natural air convection with no means of control. These two problems were solved with an annealer design, such as is shown in FIGS. 10A and 10B. This annealer easily permitted picking up of the yam at its bottom conical exit. Incoming air from a compressed air source flowed through the annular space between the inner and outer tubes and up through several fine mesh screens to eliminate turbulence and into the top and radially toward the molten filaments. Air was allowed to enter through a lower port in the annealer, and the air flow rate was controlled with a needle valve and measured by a flow meter. Temperatures within the inner tube along the top six inches could be monitored by thermocouples placed an inch apart. The height of the air inlet port between the inside and outside tube was adjustable between 1.0 in to 4.0 in. A 1.0 in high glass ring permitted visual observation of the molten threadlines and the spinneret face.

Spinning was conducted using a spinneret assembly configured as in FIG. 8 and a 30-hole 39.4-mil diameter with a length/diameter of 3.0 spinneret. Spinning occurred at a throughput of 1.3 gpm with the following temperature profile: 350° C. from the screw extruder to the pack filter, 450° C. in the transfer line and 500° C. in the spinneret. The temperatures inside the annealer were: 268° C. at 1.0-in from the spinneret face, 252° C. at 2-in from the spinneret face, and 222° C. at 6-in from the spinneret face. The temperature fluctuation was negligible with a change of only 2° C. versus up to 25° C. observed in the annealers of the previous examples herein. The shear rate was 151/sec. Maximum spinning speed achieved was 1,737 mpm. The fiber properties of denier/tenacity/elongation/modulus were: 4.2 d/1.17 gpd/57%/7.8 gpd, respectively.

The robustness of this spinning system was confirmed when excellent spinning continuity was demonstrated by production of a 3.5-hour package of yam drawn 1.4× in line. Take up roll speed and temperature were 702 m/min and 240° C., respectively; draw roll speed was 1005 m/min. The yam package had a net weight of over 20 pounds and a 2.0-in thick cake on a 6.0-in diameter bobbin. The temperature (° C.) rofile was:

| Screw Zones | Clamp Ring | Screw Adapter | Spinneret Adapter | Pack Filter | Transfer Line | Spinneret |
|---|---|---|---|---|---|---|
| 1, 2, 3 All 350 | 350 | 350 | 350 | 350 | 448 | 500 |

The fiber properties of denier/tenacity/elongation/modulus were 12.6 d/0.80 gpd/92%13.8 gpd, respectively.

Example 13

Spinning was conducted as in Example 12 but instead of PFA 340, Teflon® FEP 5100 fluoropolymer was used. The temperature (° C.) profile was:

| Screw Zones | Clamp Ring | Screw Adapter | Spinneret Adapter | Pack Filter | Transfer Line | Spinneret |
|---|---|---|---|---|---|---|
| 1, 2, 3 315, 319, 325 | 325 | 325 | 325 | 325 | 401 | 480 |

The temperatures used were lower in this example than for the PFA polymer because FEP is less stable than PFA. The shear rate was 161/sec. The maximum spinning speed achieved was 1,290 mpm. The fiber properties of denier/tenacity/elongation/modulus were 7.3 d/1.04 gpd/36%/10 gpd, respectively.

Example 14

This spin was made to test the process robustness developed in Example 13 for the Teflon® FEP 5100 polymer. Excellent spinning continuity, using the same equipment design as in Examples 12 and 13, was demonstrated with a 3.5-hour bobbin obtained at the same take-up speed of 700 mpm as in Example 12 for the PFA polymer. The yam was drawn off-line at the same draw ratio of 1.4× but at a lower temperature of 200° C. because the melting point of FEP (260° C.) is lower than the melting point of PFA (305° C.). The yam package was similar to that of the PFA 340 polymer spin in Example 12. The temperature (° C.) profile used was lower than the one used in Example 13, namely:

| Screw Zones | Clamp Ring | Screw Adapter | Spinneret Adapter | Pack Filter | Transfer Line | Spinneret |
|---|---|---|---|---|---|---|
| 1, 2, 3 305, 310, 315 | 315 | 315 | 315 | 315 | 393 | 480 |

The shear rate was 163/sec. The drawn fiber properties of denier/tenacity/elongation/modulus were 12.2 d/0.97 gpd/45%/5.8 gpd, respectively.

Example 15

A spin of PTFE homopolymer was made using pelletized Zonyl® MP-1300 PTFE. The pelletized form of the homopolymer was compacted from fine PTFE powder using a pelletizer comprising a male mold with 1,013 of 0.257-inch diameter imbedded rods and a female mold, 2.0-inch thick. The powder which had a density of about 0.36 g/ml was compacted under over 30 tons of pressure in a press to produce pellets having a 0.28-inch diameter, 0.50 inch length and a density of 1.58 g/ml. The same equipment and 30-hole spinneret as in Example 14 was used. The temperature (° C.) profile used was:

| Screw Zones | Clamp Ring | Screw Adapter | Spinneret Adapter | Pack Filter | Transfer Line | Spinneret |
|---|---|---|---|---|---|---|
| 1, 2, 3 All 400 | 400 | 400 | 410 | 410 | 450 | 520 |

The molten filaments exiting from the spinneret face appeared translucent and glittering, an indication of some degradation. The filaments, however, did not come out of the annealer in continuous form but rather in bits and pieces. Varying the throughput rate from 0.17 g/min/hole to 1.33 g/min/hole did not result in continuous filaments.

After the MP-1300 pellets ran out in the feed hopper, about 200 grams of PTFE homopolymer TE-6462 in powder form was fed into the hopper and extruded resulting in long, continuous filaments. The free-fall continuous filaments were ductile and could be handled or gently pulled between fingers without breaking. The measured denier of a filament was 349.

Example 16

In order to spin Teflon® PTFE TE-6472, the extruder and spinning apparatus used in Example 15 was brought to the following high temperature (° C.) profile, and PFA 340 was used first to avoid degradation of the PTFE homopolymer to follow due to stagnation during the heating-up process which lasted 2.5 hrs:

| Screw Zones | Clamp Ring | Screw Adapter | Spinneret Adapter | Pack Filter | Transfer Line | Spinneret |
|---|---|---|---|---|---|---|
| 1, 2, 3 All 470 | 470 | 470 | 470 | 470 | 450 | 510 |

Compressed powder pellets of Teflon® PTFE TE-6472, classified as a granular molding powder, were added after the PFA pellets feed were gone and the screw was turning at 14.0 rpm. Six minutes after the Teflon® PTFE TE-6472 pellets were added, the pack pressure was found rapidly rising from 204 psi to over 1,000 psi indicating that the Teflon® PTFE TE-6472 had reached the pack. Screw speed was constantly adjusted and spinneret temperature raised to 550° C. to maintain pack pressure at 1,000 psi. Continuous transparent molten filaments were extruding but contained gas bubbles, an indication of thermal degradation, and solidifying into white filaments. At 2.0 rpm, the measured throughput was 7.6 gpm versus an expected 10.5 gpm. Even though the screw rpm was maintained at 2.0 rpm, the throughput was found to continuously decrease to as low as 0.4 gpm, and the continuous filaments began to break up into drips connected between long (as long as 48-in) and very fine filaments. These very fine filaments were visually similar to a light spider web, so light that they floated in the air. Measured filaments denier was between less than 0.6 and 18. This clearly demonstrated that PTFE could be melt spun even to very fine filament denier.

The cause of the reduction in throughput was ring pluggage at the entrance to the barrel of the extruder, which effectively prevented the feeding of the fluoropolymer pellets. In order to clear the pluggage, all of the polymer was vacuumed out until the screw was visible. Then PFA pellets were added and pushed down using a specially made rectangular plate, attached to a 0.5-inch rod, which had the dimension of the barrel opening. Turning the screw caused the small PFA pellets to scrape off the stuck PTFE compressed powder from the screw surface.

After the ring pluggage was cleared and feeding resumed, the PTFE compressed powder pellets were added again. At a screw speed of 5.0 rpm, with a measured throughput of 9.3 gpm, continuous filaments from all 30 holes were spun and taken up on take-up rolls at 30 mpm. Excellent spinning continuity lasted about 15 minutes before ring pluggage occurred again as evidenced by a drop in pack pressure. This experiment clearly demonstrated that homopolymer PTFE can be melt-spun. The temperature (° C.) profile was:

| Screw Zones | Clamp Ring | Screw Adapter | Spinneret Adapter | Pack Filter | Transfer Line | Spinneret |
|---|---|---|---|---|---|---|
| 1, 2, 3 420, 440, 480 | 485 | 485 | 485 | 485 | 495 | 500 |

The PTFE fiber samples were ductile permitting handling without brittle failure and permitted tensile testing.

| Sample Identification | Filament Denier | Strength (grams) | Tenacity (gpd) |
|---|---|---|---|
| Free fall | 686 | 36.0 | 0.05 |
| Free fall | 1,042 | 71.8 | 0.07 |
| 30 mpm | 332 | 14.0 | 0.04 |

Example 17

Spinning was conducted on Teflon® PTFE 62, classified as a lubricated paste extrusion resin. The powder was similarly compressed under 50 tons of pressure into cylindrical pellets 0.28-inch in diameter and 0.52-inch in length and with a density of about 1.6 g/cc.

The same equipment and start-up procedure was used as in Example 16. The Teflon® PTFE 62 pellets were added at 3.8 rpm screw speed. Good feeding was obtained at beginning and measured throughput was 9.9 gpm versus 20 gpm expected. Screw speed was increased to 7.7 rpm. Pack pressure was found to rise continuously and was held at 1,200 psi by reducing the screw speed indicating good feeding. Ring pluggage occurred and pack pressure dropped. Rewing up the screw to 30 rpm loosened the pluggage and the pack pressure rose. At 10 rpm, the pack pressure climbed to as high as 2,150 psi when continuous filaments were spun at 55 mpm. Spinning continuity lasted about 5 minutes before ring pluggage occurred.

Example 18

The fibers spun in Examples 16 and 17 were hot drawn in a heated salt bath. Filaments were cut to about one inch in length and were held between pointed tweezers and drawn while briefly immersed in a salt bath. Draw temperature ranged from 330° C. to 400° C. The fiber could not be drawn at 320° C. The melting point of PTFE homopolymer ranged from 325° C. to 342° C., thus the fibers were drawn in the molten state. The filaments were easily drawn between 5.0× to 8.0× draw ratio. The filaments changed from a bright with no preferred orientation, under cross-polaroid filters, to a intense blue color in one direction and pinkish red in a direction 90° to it, indicating preferred molecular orientation along fiber axis. A 340° C. draw temperature gave the highest degree of orientation. A drawn filament with a measured denier of 7.7 gave 0.2 gpd in tenacity.

Example 19

The spinneret assembly described in Example 9 and shown in FIG. 6 was used to spin Teflon® PFA 340 and to compare the spinning conditions found with a conventional spinneret assembly design (see FIG. 1), where the spinneret cannot be heated separately, with spinning conditions in which the spinneret is thermally isolated from the pack filter. Thermal isolation was obtained in part in this embodiment by adding a transfer line between the bottom face of the pack filter and the spinneret face.

Two control runs were made using the same spinneret system but keeping the spinneret at the same constant temperature. A 10-hole 30-mil spinneret was used.

The first control spin was made by keeping the temperature (° C.) profile at 350° C. as shown below:

| Screw Zones 1, 2, 3 | Clamp Ring | Screw Adapter | Spinneret Adapter | Pack Filter | Transfer Line | Spinneret |
|---|---|---|---|---|---|---|
| All 350 | 350 | 350 | 350 | 350 | 350 | 350 |

The throughput was increased until a slight melt fracture was observed at 0.178 gpm per hole. The shear rate at this maximum throughput was 45.7/sec, and the maximum spinning speed achieved was 58 mpm having a jet velocity of 0.26 mpm and a SSF of 223.

The second control spin was made at a higher temperature profile of 400° C. as shown below:

| Screw Zones 1, 2, 3 | Clamp Ring | Screw Adapter | Spinneret Adapter | Pack Filter | Transfer Line | Spinneret |
|---|---|---|---|---|---|---|
| All 350 | 350 | 350 | 350 | 400 | 400 | 400 |

The higher temperature of 400° C. permitted higher throughput of 0.370 gpm per hole before melt fracture. At a lower throughput, before melt fracture, of 0.238 gpm per hole, a maximum spinning speed of 206 mpm was obtained. At the highest throughput and at the edge of melt fracture, the achieved maximum spinning speed was 381 mpm at a shear rate of 95/sec, jet velocity of 0.54 mpm and a SSF of 704.

The following temperature (° C.) profile was used:

| Screw Zones 1, 2, 3 | Clamp Ring | Screw Adapter | Spinneret Adapter | Pack Filter | Transfer Line | Spinneret |
|---|---|---|---|---|---|---|
| 325, 330, 335 | 335 | 335 | 335 | 335 | 450 | 500 |

With this temperature profile, the throughput could be pushed to as high as 1.125 gpm per hole, 3 times higher than the uniform 400° C. control, and still without melt fracture. Achieved maximum spinning speed was 1,956 mpm, 5 times higher than the uniform 400° C. control, at a shear rate of 289/sec, jet velocity of 1.645 mpm and a SSF of 1,189.

A control run was not simulated at 500° C. because in a conventional spinneret system, the pack filter has to be heated to the same 500° C. temperature. With the pack filter at 500° C., the polymer would seriously degrade due to the long residence time, 10.1 minutes, in the pack filter. At 425° C., the polymer would begin degrading in less than 1.3 minutes.

Example 20

The following experiment was conducted to determine the distance from the spinneret face when the molten filaments would solidify. Solidification was determined to have occurred when it was visually observed that the transparent molten filaments turned opaque. This observation was more clearly observed with a high intensity lamp shining directly at the bundle of filaments. The transition from transparent to opaque was observable from free-fall (by gravity) to speeds up to 200 mpm. Extrusion of the molten filaments were conducted with and without an annealing tube. In the case where an annealing tube was used, a special clear glass annealing tube was used in order to permit visual observation and which measured 3.0-inch in diameter and 41-inch long. The spinneret used had 30 holes of 30-mil diameter. Teflon® FEP-5100 polymer was used.

Figure 13:
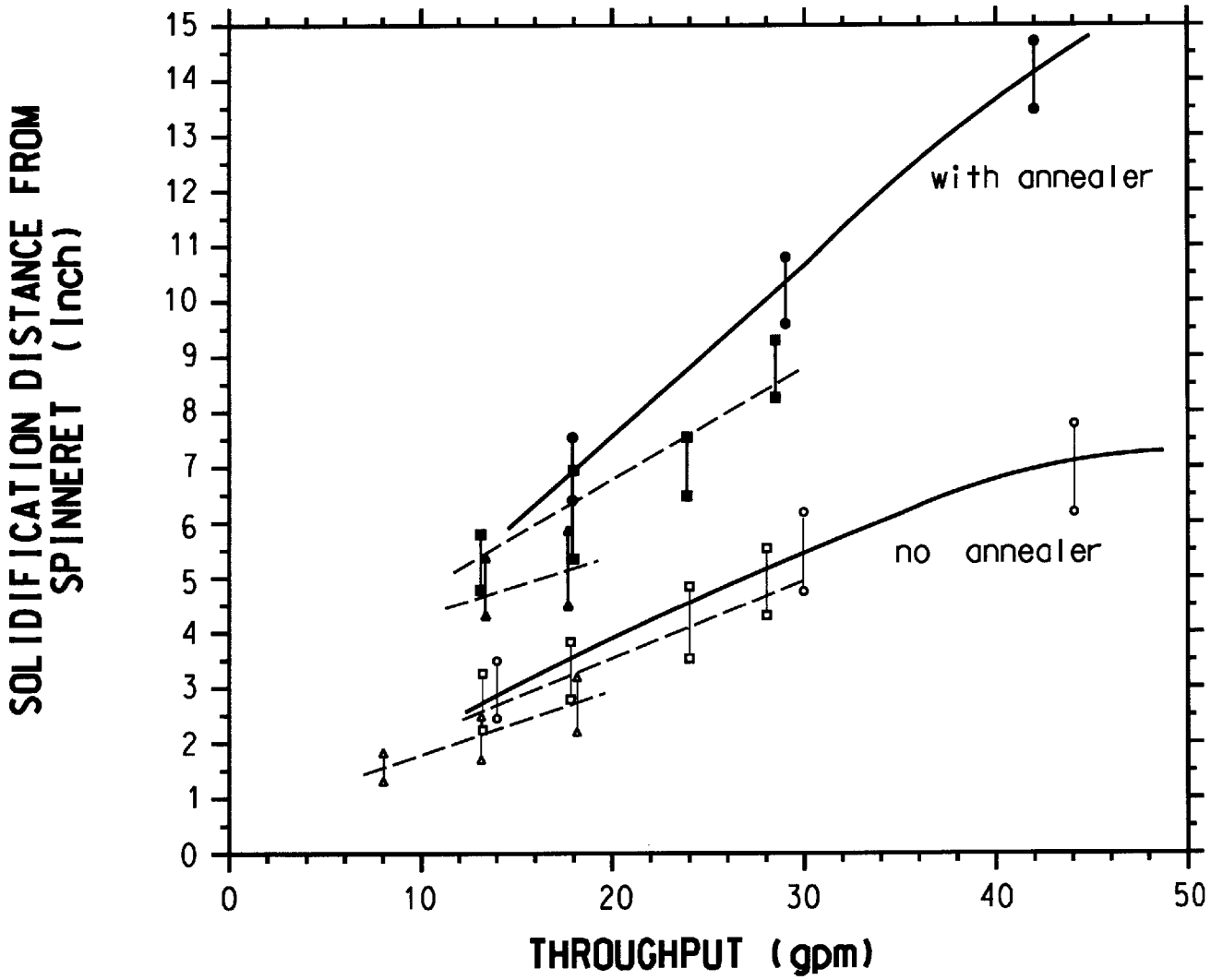
FIG. 13 is a graphical representation of throughput vs. solidification distance from a spinneret with and without an annealer using Teflon® FEP-5100, a 30-mil/30-filament spinneret, a 3-in diameter, 41-in long annealer, and spinneret temperatures of 380° C. (triangle), 430° C. (square) and 480° C. (circle), wherein the open symbols represent no annealer and the darkened symbols represent use of an annealer.

The results plotted in FIG. 13 show the data without an annealer in opened symbols while those using an annealer in filled symbols. The plot shows the free-fall distance as an increasing function of total throughput at three constant spinneret temperatures: 380° C. (triangle symbol), 430° C. (square symbol) and 480° C. (circle symbol). It shows that the solidification distance increases with total throughput at constant spinneret temperature. It also shows that the solidification distance increases with increasing spinneret temperature at the same throughput. Furthermore, it shows that with an annealing tube, the solidification distance is about twice as far as that without an annealing tube.

The effects of stringing up the filaments were shown in another experiment to increase the solidification distance from about 6 inches to about 15 inches without an annealing tube at a take-up speed of 200 mpm. Therefore, the solidification distance shown in the FIG. 13 represents the shortest solidification distance.

The following temperature (° C.) profile was used:

| Screw Zones 1, 2, 3 | Clamp Ring | Screw Adapter | Spinneret Adapter | Pack Filter | Transfer Line | Spinneret |
|---|---|---|---|---|---|---|
| 275, 285, 295 | 315 | 315 | 315 | 315 | 380 | 380, 430, 480 |

Example 21

PTFE homopolymer grade, Zonyl® MP-1600N (micropowder), was melt-processed and spun into fibers, using a spinneret assembly as depicted in FIG. 8. The polymer powder was compressed in a 0.5-in high female mold with 0.25-in diameter holes, which were filled with the polymer powder, using less than 0.25-in diameter rods into thin discs of about 0.1-in thick. About two pounds of these thin disc pellets were made. The pellets were hand fed into the screw extruder just enough to fill the threads section of the screw as a precaution against being crushed and causing sticking and ring pluggage in the screw. The following temperature profile was used.

| Screw Zones 1, 2, 3 | Clamp Ring | Screw Adapter | Spinneret Adapter | Pack Filter | Transfer Line | Spinneret |
|---|---|---|---|---|---|---|
| 380, 385, 390 | 390 | 390 | 390 | 390 | 450 | 500 |

At a screw speed of 1.94 rpm, the throughput was at 9.4 grams per minute with a pack pressure of 238–246 psi using a 10 holes 30-mil diameter spinneret. The shear rate was 242/sec. The annealer used in Example 12 and shown in FIGS. 10A and 10B, was used. No ring pluggage problems were experienced. The spin was cut short after running out of pellets.

The 10 filaments was initially picked up by hand and went over to the take-up roll and after one wrap, a sucker gun was used to string up the yam all the way to the Leesona windup. The initial spinning speed was 30 mpm and speed was gradually increased to a maximum of 202 mpm. Filament denier measurement on three filaments were: 33, 36 and 41. The measured as-spun filament fiber properties for the 41 denier filament (denier/tenacity/break elongation/modulus) were: 41 denier/0.05 gpd/1.3%/3.7 gpd.

Teflon®) PTFE 62 was spun using cut-up pieces and thin disc pellets to avoid the ring pluggage. The temperature (° C.) profile used was:

| Screw Zones 1, 2, 3 | Clamp Ring | Screw Adapter | Spinneret Adapter | Pack Filter | Transfer Line | Spinneret |
|---|---|---|---|---|---|---|
| 440, 445, 450 | 450 | 450 | 450 | 450 | 450 | 500 |

The cut-up pellets fed well with no pluggage. However, the pellet discs eventually developed a ring pluggage problem. Spinning at up to 60 mpm was achieved before the pluggage occurred at shear rate ranging from 183/sec to 614/sec.

Example 22

Pellets of Zonyl® MP-1600N PTFE homopolymer powder were similarly prepared as in Example 21, using the same spinneret assembly. At the following temperature profile, the effects of an annealer were studied by spinning without and with the annealer. Throughput rate was at 8.4 grams per minute through a 30-mil diameter, 30-hole spinneret for a shear rate of 72/sec.

| Screw Zones 1, 2, 3 | Clamp Ring | Screw Adapter | Spinneret Adapter | Pack Filter | Transfer Line | Spinneret |
|---|---|---|---|---|---|---|
| 315, 330, 340 | 340 | 340 | 340 | 340 | 400 | 400 |

Without annealer. About 15% of these extruding filaments could not sustain their own weight at a vertical free fall distance of 5-ft 8-in. For those surviving filaments, they were able to be spun at a maximum speed of only 15 mpm before they broke.

With a 48-in long annealer: All filaments were free falling continuously to the floor. The first filament-break (FFB) spinning speed was 50 mpm and the maximum spinning speed (MSS) attained was 480 mpm. By raising the temperature of the transfer line and spinneret to 450° C. and 500° C., the FFB was improved to 85 mpm and the MSS was at 250 mpm. The yarn was visibly thick and thin. The yam uniformity was found to improve with the introduction of room temperature air through the annealer jacket into the top of the annealer. At 250 cfh (cubic feet per hour), the yam became uniform. Under this condition of spinning, the MSS was improved to 404 mpm. Filament fiber properties (denier/tenacity/break elongation/modulus) were 5.8/0.16gpd/1.2%/8 gpd. The weak (low tenacity) and brittle nature of the filaments spun from the micropowder in this Example and the preceding Example find utility in applications in which they are supported such as when the filaments are broken up into staple fibers and embedded in a binder matrix for use as low friction slides for furniture moving or spacers (flat bearings) between opposed objects.

Example 23

This experiment used Teflon® FEP-5100 as the fluoropolymer composition and demonstrated the advantage of thermally isolating the spinneret. A spinneret assembly as depicted FIG. 8 was used. The control was run in the same assembly but keeping the temperature the same for all parts. The temperature(° C.) profiles for the controls were:

| Screw Zones 1, 2, 3 | Clamp Ring | Screw Adapter | Spinneret Adapter | Pack Filter | Transfer Line | Spinneret |
|---|---|---|---|---|---|---|
| 275, 300, 350 | 350 | 350 | 350 | 350 | 350 | 350 |
| 275, 300, 350 | 400 | 400 | 400 | 400 | 400 | 400 |
| 275, 300, 350 | 400 | 450 | 450 | 450 | 450 | 450 |

The temperature profile in the Screw Zones 1 and 2 was kept low and not at test temperature until Screw Zone 3 or Clamp Ring. The degradation would have been worse had Screw Zones 1 and 2 been at test temperature.

The temperature profile for the sample of the present invention was:

| Screw Zones 1, 2, 3 | Clamp Ring | Screw Adapter | Spinneret Adapter | Pack Filter | Transfer Line | Spinneret |
|---|---|---|---|---|---|---|
| 275, 295, 300 | 300 | 300 | 300 | 300 | 380 | 480 |

Figure 16:
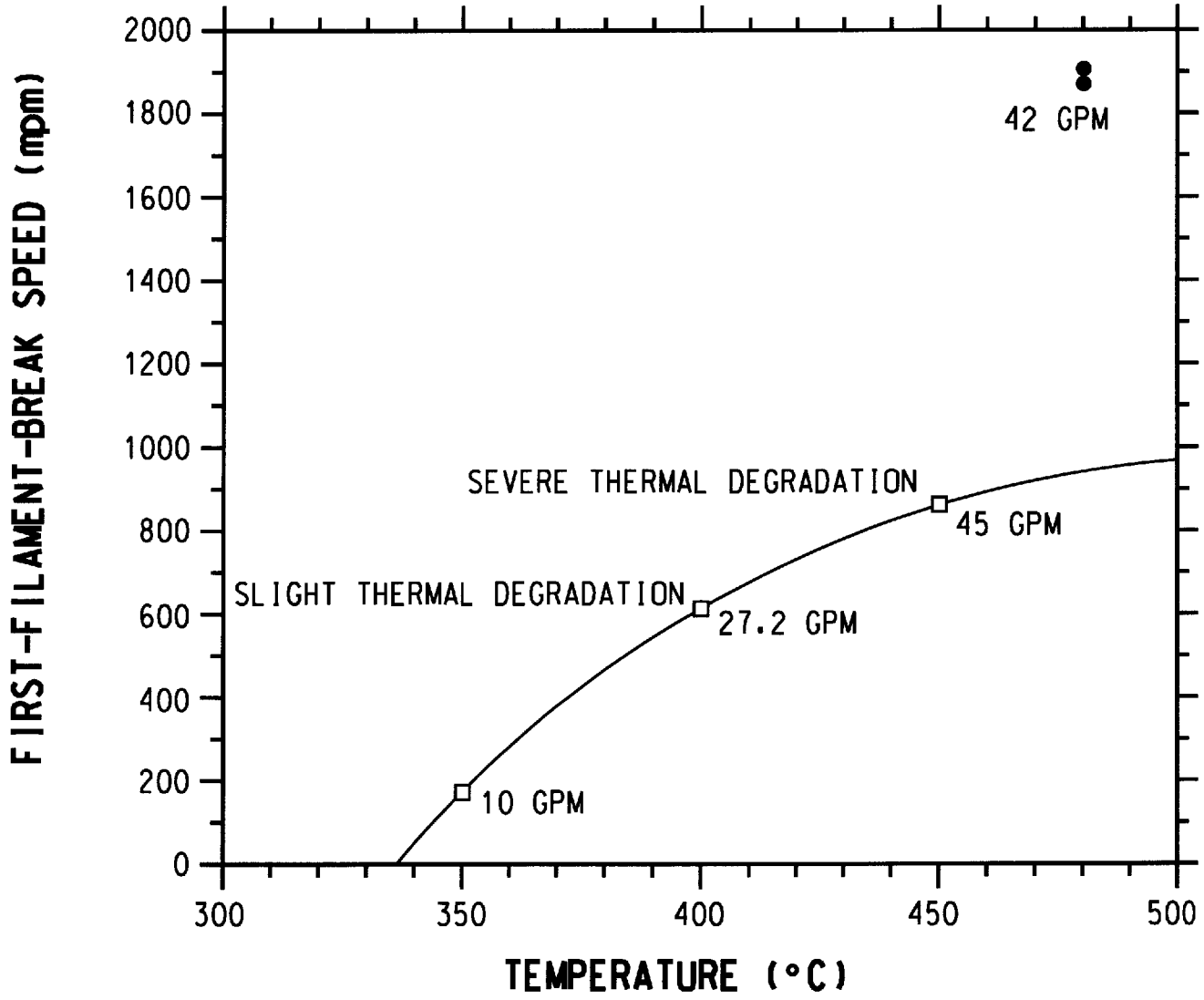
FIG. 16 is a graphical representation of temperature vs. first filament break speed (mpm) for Example 23, wherein the darkened circle represents the sample of the present invention and the square represents the comparative sample.

The shear rates were: 86/sec at 10 gpm, 232/sec at 27.2 gpm, 359/sec at 42 gpm, and 385/sec at 45 gpm. As seen in FIG. 16, a spinning speed of 1,900 mpm, without any noticeable degradation, was achieved at a spinneret temperature of about 480° C. However, the control experienced slight thermal degradation at a spinneret temperature of 400° C. attaining a spinning speed of about 600 mpm at that temperature and severe thermal degradation at about 450° C. with a spinning speed of 900 mpm.

Conditions for Examples 24–26

In the following Examples 24–26, yam spinning is conducted using a 1.5-inch diameter steel single screw extruder connected to a gear pump, which is in turn connected through an adapter to the spinneret assembly which includes a screen pack to filter the molten polymer, an extension to essentially thermally isolate the spinneret from the screen pack. The gear pump, adapter, screen pack, and spinneret (faceplate) are heated by external heaters, similar to FIG. 2 except that the adapter is heated. The spinneret faceplate has 30 holes (extrusion orifices) arranged in a circle, each hole being 30.0 mil (760 $\mu$m) in diameter. The length of the spinneret capillaries is 90 mils (2.3 mm). The molten filaments are melt spun into and through the annealer described in Example 12 and FIGS. 10A and 10B. Fiber exiting the holes in the spinneret passes six times around a take-up (feed) roll and then around a first and a second set of two rolls for heat setting, and then to a final windup roll. Fiber drawing is done between the feed roll and second roll set, the second roll set speed divided by the feed roll speed being the "draw", except for Comparative A wherein the second roll set is not used, and draw is determined by the feed roll speed relative to the greater speed of the first roll set.

Example 24

Tefzel® ETFE fluoropolymer, MFR 29.6 and melting point of 258° C., is spun according to the teachings of this invention, using the annealer of FIGS. 10A and 10B operated in the manner as described in Example 12. The uniform air-cooling of the molten filaments within the annealer obtained by shielding the molten filaments from turbulent air delays the solidification of the filaments until they are at a distance of at least 50× the diameter of the spinneret extrusion orifice. The conditions (temperatures in ° C.) are summarized in Table 1.

TABLE 1

| Extender Zones | | | Gear | | Screen | |
|---|---|---|---|---|---|---|
| Feed | # 1 | # 2 | pump | Adapter | pack | Spinneret |
| 250 | 300 | 300 | 300 | 300 | 300 | 380 |

| Feed roll | First roll set | Second roll set | Draw |
|---|---|---|---|
| 400 m/min 150° C. | 500 m/min 230° C. | 1100 m/min 150° C. | 2.75X |

The resulting fiber is 435 denier, and has a tenacity of 1.83 g/denier, a modulus of 24.1 g/denier, and an elongation of 28%. The differential birefringence is measured and shows the skin of the fiber to be less oriented than the core, in particular, the birefringence of 0.0468 at the center of the filaments decreases from about this same birefringence to less than 0.044 as the measurement approaches 0.95 the length of the radius from 0.8 the length thereof.

Example 25

Example 24 is repeated except that the second roll set is run at 1400 m/min, resulting in a draw of 3.5×. The resulting fiber is 350 denier, and has a tenacity of 2.3 g/denier and an elongation of 18%, showing that the tenacity of the yam produced in Example 1 can be increased, while still obtaining high yam elongation just by a small amount of additional draw. The differential birefringence is measured and shows the surface of the fiber to be less oriented than the core.

Example 26

The conditions of Example 24 are followed generally except that the spinneret temperature is 360° C. and the melt temperature before the spinneret (screen pack) is about 270° C. The filaments solidify at a distance from the extrusion orifice of at least 50× the diameter thereof. The conditions (temperatures in ° C.) are summarized in Table 2.

TABLE 2

| Extender Zones | | | Gear | | Screen | |
|---|---|---|---|---|---|---|
| Feed | # 1 | # 2 | pump | Adapter | pack | Spinneret |
| 250 | 265 | 270 | 270 | 270 | 270 | 360 |

| Feed roll | First roll set | Second roll set | Draw |
|---|---|---|---|
| 400 m/min 150° C. | 500 m/min 230° C. | 1100 m/min 150° C. | 2.75X |

The resulting fiber is 414 denier, 2.44 g/denier tenacity, has 18.8% elongation, and has a denier uniformity characterized by a coefficient of variation of 1.6%. The differential birefringence is measured and shows the surface of the fiber to be less oriented than the core. This example shows that 360° C. spinneret temperature is sufficient to make fiber according to this invention.

Comparative Example A

This example is conducted at conditions approximating those disclosed in Japanese Patent Application (Kokai) No. 63-219616 (1988), Example 1 using the polymer and melt processing equipment of Example 24 above. The conditions (temperatures in ° C.)are summarized in Table 3.

TABLE 3

| Extender Zones | | | Gear | | Screen | |
|---|---|---|---|---|---|---|
| Feed | # 1 | # 2 | pump | Adapter | pack | Spinneret |
| 250 | 300 | 300 | 300 | 300 | 300 | 300 |

| Feed roll | First roll set | Second roll set | Draw |
|---|---|---|---|
| 20 m/min 150° C. | 120 m/min 230° C. | not used | 6X |

The resulting yam is 1074 denier, 2.69 g/denier tenacity, and has 15.7% elongation. The differential birefringence is measured and shows the surface of the fiber to be more oriented than the core; in particular, the filament center birefringence is 0.054 and this birefringence increases from about this same birefringence to 0.055 as the measurement increments move along the filament radius from 0.8 to 0.95 the length of the radius towards the surface of the filament. This example demonstrates that fiber spinning according to the teachings of the prior art results in differential birefringence opposite that obtained in this invention. Of course, the spinning speed (120 m/min) is so slow as to be unacceptable from an economic standpoint.

Comparative Example B

This example is conducted to show the effect of spinning at the same high polymer throughput and wind-up speed as Example 24, but at a melt spinning temperature of only 300° C. The conditions (temperatures in ° C.) are summarized in Table 4.

TABLE 4

| Extender Zones | | | Gear | | Screen | |
|---|---|---|---|---|---|---|
| Feed | # 1 | # 2 | pump | Adapter | pack | Spinneret |
| 250 | 300 | 300 | 300 | 300 | 300 | 300 |

| Feed roll | First roll set | Second roll set | Draw |
|---|---|---|---|
| 400 m/min 150° C. | 500 m/min 230° C. | 1100 m/min 150° C. | 2.75X |

The resulting fiber is 423 denier, 2.87 g/denier tenacity, and has 7.5% elongation. The differential birefringence is measured and shows the surface of the fiber to be more oriented than the core. In particular, the birefringence of 0.054 at the center of the filament increases to 0.057 adjacent the surface of the filament. This example demonstrates that absent the high spinneret temperatures of this invention the fiber has differential birefringence opposite that obtained in this invention. This yam cannot be drawn further because of the disadvantageously low elongation. To increase the elongation to at least 15%, the draw will have to be decreased, resulting in a tenacity of less than 2 g/d.

The many articles described in the following Examples 27 to 33 can be made from yams such as those prepared in the foregoing Examples and in Example 34. Such articles, however, are not limited to these yams. It is contemplated that from the disclosure of the present invention will come other processes for melt spinning highly fluorinated thermoplastic polymer that will be usable to prepare yarns that can be used to make such articles.

Example 27

Sewing thread of yam, similar to that prepared in Example 26, having a denier of 437, is made by (a) applying a twist to the yam of one twist/cm, (b) plying three ends of such yarn together at a twist of one/cm but in the opposite direction from the twist in the yam, and (c) heat setting the resultant thread at 150° C. under tension. A binder or finish can then be applied to the thread if desired. The resultant sewing thread is a balanced, corded construction having a uniform denier and exhibiting excellent stitch loop formation, without any propensity to knot or snarl. Such thread may be ideally be used to stitch fabrics subject to outdoor exposure because of the ability of ETFE to resist the effects of UV radiation and moisture and thereby endure the effects of weathering. Yam of this invention preferably has a tenacity of at least 3 g/den as shown in Example 34 and produces a strong thread needed for this application. The low friction of coefficient of ETFE allows yam to penetrate heavy fabric easily during the sewing operation.

The superior tensile properties of ETFE yam which are appreciated for sewing thread have applicability to medical and veterinary textiles such as sutures, patches and grafts. In addition, ETFE is flexible, chemically inert and resists the attack of body fluids. ETFE yam for this application may be monofilament or multifilament. The suture yam can be braided. For example, a suture yam can be made in the manner as described above for preparing sewing thread. Yam having a denier of 160, is made by (a) applying a twist to the yam of one twist/cm, (b) braiding 4 ends of such yam together, and (c) heat setting the resultant suture at 150° C.

under tension. The resultant suture has a tenacity of 3.0 g/den, elongation to break of 10% and tensile quality of 9.5.

The superior tensile properties appreciated for sewing thread have applicability to dental floss. Dental floss is effectively used to clean the spaces between teeth and at the interface of the tooth near the gum line. There is a desire for the floss to have characteristics that allow it to easily pass through the narrow spaces of the teeth and yet still be effective in removing food particles, debris and plaque from the surface of the tooth. The yarn should be strong so as not to prematurely break while cleaning between teeth. Further, the floss should not be too lubricious or smooth that it will be difficult to grip. Two types of floss are in common use—PTFE filaments and less costly fibers such as nylon. Because of the low coefficient of friction of PTFE, such floss has the ability to easily slip through the narrow spaces of the teeth. However, PTFE is very expensive to produce and difficult to grip. Lower cost fiber such as nylon has also been used, but because of its higher coefficient of friction, the floss may break and shred and become stuck between the teeth. Difficulty also arises if the user pulls downward to increase the ease of passage and as a result causes gum irritation. Many manufacturers have attempted to coat less costly fibers with wax or other lubricant to reduce the coefficient of friction, but this adds another manufacturing step to the process and may not be as effective.

ETFE multifilament thread made by the present invention or by other processes possesses a coefficient of friction which is low enough to facilitate slipping the thread though narrow spaces between teeth but higher than that of polytetrafluoroethylene (PTFE), therefore having the added abrasion effectiveness desired. The dynamic coefficient of friction (u=900 m/s) is 0.23 as compared to PTFE which has a dynamic coefficient of friction of 0.1.

In a preferred embodiment of this invention, it is recognized that a preferred multifilament configuration for a given denier of floss yam, contains fewer large diameter filaments as compared to many small diameter filaments. As a result, break strength per filament, having reduced shredding tendency within the floss, is increased.

For example, dental floss can be made in the manner as described above for preparing sewing thread. Yam having a denier of 400(40 den/filament), is made by (a) applying a twist to the yam of one twist/cm, (b) plying 6 ends of such yam together, and (c) heat setting the resultant floss at 150° C. under tension. The resultant floss has a denier of 1600 a tenacity of 3.0 g/den, an elongation to break of 10% and a tensile quality of 9.5.

Preferred filament configurations of dental floss yarn contain 20 to 200 filaments and a denier per filament of from about 15 to about 70. Floss of this configuration has a break strength (elongation to break) of elongation 8 to 15% and in this way, eliminates shredding and splaying of the yam fibers.

To increase the effectiveness, medicinal ingredients such as fluoride compounds to prevent tooth decay or bactericides to inhibit periodontal disease can be applied to the floss. Binders, waxes and flavorants can also be applied to the floss. ETFE yam made according to this invention or by other process can also be used to produce musical instrument strings, racquet strings, ropes, cords, fishing line and the like. For example, fishing line used in casting, baitfishing, trolling etc. should have a combination of high tensile strength, flexibility and longitudinal stiffness. In addition, these properties should remain substantially constant after extended exposure to water. ETFE, possessing excellent tensile properties (tenacity, elongation, and modulus ASTM D 1577) as well as excellent resistance to moisture regain (hygroscopicity) is found to satisfy these needs. The moisture regain (hygroscopicity) as determined by ASTM 570, is less than 1% and far superior to nylon or coated nylon commonly used in the fishing industry today. The yarn used to make the sewing thread described above is used to form fishing line by braiding together four ends of such yams, the resultant fishing line having a denier of 1750 and break strength of 10.5 lbs and elongation to break of 10%. Instead of the fishing line containing multifilament yam, it can be made of monofilament of the same denier to provide similar break strength and elongation.

Example 28

Another embodiment of the present invention is netting made of yam comprising ETFE fiber. The fiber can be continuous filament or staple fiber, multifilament of monofilament, and the yam preferably has a tenacity of at least 3 g/den. The preferred method for making this yam is disclosed hereinbefore, but high tenacity yam made by other processes can be used.

The chemical stability (inertness) of the ETFE fiber enable netting made from the fiber to be used above ground and below ground, and to withstand exposure to weather, including sunlight, and to water, including salt water. Examples of netting include such utilities as fish net, golf netting used for example as a barrier to errant golf balls, soccer netting, agricultural netting used for example to protect crops from birds, and geotextiles. Geotextiles are netting used on or under the ground for such applications as pond liners, soil stabilization, and erosion protection. The openness of the netting, i.e. the size of the apertures will depend on the needs of the application. Generally, however, the yam used in the netting of the present invention will have a denier of at least 1000, and the yams will be twisted and plied together to form the cords of the netting to have the strength desired for the particular netting application. The netting of the invention can be made by conventional means, such as wherein the apertures in the netting are maintained by knotting of the strands of the netting at their crossovers. Instead of knotting at strand crossovers, the netting can be formed by braiding (U.S. Pat. No. 4,491,052). An example of a fish net is that which has mesh openings of 1 to 3 in and break strength for the cords making up the netting of at least 10 lb. An example of netting useful in such applications as soccer net, tennis net, and golf net is as that which has about 1 $in^2$ openings and has a cord strength of greater than 100 lb, preferably 150 lb, obtained from plying together 40–50 ends of 400 denier yam, such as made in accordance with the process of Example 34. The resultant yam, while of high denier is compact because of the high density of ETFE relative to nylon. An example of another net is baseball net protecting spectators and batting cage net having a mesh size of at least ¾ in. and cord strength of at least 120 lb, preferably at least 200 lb. Another example is football netting to protect spectators from kicked footballs; this netting has a larger mesh size and cord breaking strength of at least 100 lb, preferably at least 150 lb.

Example 29

Composite Structures

This Example describes composite structure comprising fabric containing yam comprising fiber of highly fluorinated thermoplastic polymer and binder matrix. The yam in this embodiment includes fibers of such fluoropolymers as FEP, PFA and ETFE, preferably made by the processes disclosed herein, but not restricted to such processes. The yam should have a tenacity of at least 2 g/den, preferably at least 3 g/den, and can be multifilament or monofilament, and in the case of continuous strands characterizing multifilaments, the fiber can be continuous filament or staple. The yam can also be core-spun yam, wherein a strand of fluoropolymer fiber is wrapped around a core strand of another fiber, e.g. glass fiber, carbon fiber or aramid fiber. The yam can also have a braided composite construction, wherein multifilament yarn of highly fluorinated thermoplastic polymer is braided around a core strand of such materials as just described.

The composite structure of fabric and binder matrix may be rigid or flexible, depending on the choice of binder matrix and its thickness, which in turn is governed by the application intended. Flexible composite structure may be combined with rigid structures such as plastic honeycombs to form rigid structures.

In the Handbook of Composites (edited by George Luban, Van Nostrand Reinhold Company, Inc., 1982), a composite is described as a combined material created by the synthetic assembly of two or more components of selected filler (or reinforcing agent) and a compatible matrix binder (i.e., a resin). The matrix binder impregnates, i.e. saturates the filler, the fabric in the present invention. Although it is composed of several different materials, the composite behaves as a single product, providing properties that are superior to those of the individual components. The manufacture of structural and components in such fields as aerospace, automotive applications and sporting goods relies on composite materials to yield products that are lightweight with high strength and good dimensional stability even under challenging environmental conditions. Electrical applications impose additional requirements with respect to electrical properties and may require the composite structure to be flexible. Fabric of thermoplastic fluoropolymer has great advantages in these applications.

In accordance with one embodiment of composite structure of this invention, thermoplastic fluoropolymer may advantageously be used in a fabric for reinforcement for such electrical, including telecommunication applications as printed wiring boards, radar domes (radomes) and antenna domes.

With respect to the printed wiring board application the composite structure of the present invention provides an electrically insulating, dimensionally stable base of improved electrical properties for the thin electrically conductive metal layers adhered to one or both surfaces of the composite structure. The electrically conductive metal layer(s) may be formed, by commonly known photosensitive etchant resist procedures, into electric current pathways on the composite structure surface, while the rest of the portions of the metal layers are removed. Various electrical circuit devices can be attached to the composite structure by drilling mounting holes for the leads of the devices through the retained metal pathways and supporting composite structure. The electrical leads of circuit devices are inserted into the mounting holes and soldered to the metal pathways. Such wiring boards are often composed of multiple layers of reinforced composite structure, adhered metal pathways and electrical devices and the layers are connected through the mounting holes by plating the hole with a conductive metal.

Printed wiring boards have become increasingly more complex, each board being composed of more layers and each board containing more electrical devices. However, there is a demand for an even greater density of devices, increased electrical speed and greater reliability. Therefore boards that are strong, dimensionally stable, defect-free and are preferably composed of materials that increase speed are highly desirable. It has been found that a fabric containing yarn comprising highly fluorinated thermoplastic fluoropolymer can be advantageously used as a substrate in printed wiring boards. The composite structure of this invention has a lower dielectric constant and lower dissipation factor leading to increased circuit speeds. Further the composite structure of this invention shows increased dimensional stability and lower hygroscopicity (moisture and solvent regain) than known composite structures.

The composite structure used in this embodiment can comprise a fabric, such as formed by weaving, of yam comprising fiber of the thermoplastic fluoropolymer. The fabric serves as a reinforcement of the binder matrix and therefore of the conductive layer(s) adhered thereto similar to the glass fabric presently used, together with binder matrix, in printed wiring board reinforcement. The dielectric constant (ASTM D150, 1 MHz) of a fluoropolymer such as ETFE in the fabric is 2.5 and of FEP and PFA is even lower, i.e. 2.1. The dielectric constant of glass is 6.8. The lower dielectric constant of the fluoropolymer-containing fabric reinforcing the composite structure of this invention promotes faster, stronger signal propagation in printed circuit wiring boards. The presence of the fluoropolymer in the reinforcing fabric improves the ease and accuracy of drilling electrical interconnect holes in the boards.

The binder matrix used in this application of composite structure of the present invention is typically polymerized resin, such as thermoplastic resin or thermoset resin, the latter undergoing thermally-induced crosslinking to form a stable composite structure component. With respect to the thermosetting resins used, it has been common to form a partially cured preform comprising resin and glass fabric reinforcement. This partially cured preform method can be used with respect to the fabric and binder matrix used in the present invention. The partially cured preform can be called B-staged preform. whereby the resin is heated to a sufficient temperature to form a tack-free composite structure but where the composite structure will still flow when subjected to additional heat. The tack-free preform can be wound and stored for later processing. In a subsequent operation, as additional heat is applied to the preform to fully cure the thermoset resin, the above mentioned electrically conductive metal layers can be simultaneously adhered to the composite structure taking advantage of the flow of the resin prior to reaching a fully crosslinked condition. If the resin is a heat curable thermoset resin, conductive metal layers can be adhered to a tack-free partially cured preform while the composite structure undergoes complete curing. Preferred thermoset resins for impregnating the fabric include epoxy, bismaleimide or cyanate ester resin systems as well as phenolic, unsaturated polyester and vinyl ester resins. The partially cured preform impregnated with polymerized resin preferably contains from 40 to about 70% by weight resin based on the weight of the resin and the fabric. The completely cured composite structure of fabric impregnated with resin typically contains a lower proportion of resin, because of resin outflow and trimming away of excess (outflowed) resin, resulting from heat and pressure applied to unite the fabric/binder matrix composite structure with electrical conductor material, typically copper sheet, whereby the resultant composite structure includes the compressed fabric/binder matrix sandwiched between two layers or films of electrical conductive material. The compressed fabric/binder matrix contains from 30 to about 60% by weight resin based on the weight of the resin and the fabric.

The B-stage preform can be prepared in the same way used to prepare the present glass fabric/binder matrix composite structures. For example, one or more plies of fabric used in the present invention is impregnated with binder resin such as epoxy resin by unwinding a roll of the fabric and passing it through a bath of resin solution. The wetted fabric is passed between a pair of opposed pick-up control rods that are uniformly spaced-apart at a preselected distance to regulate the amount of resin solution retained by the impregnated fabric and to determine the thickness of the composite structure. Solvent is then removed from the impregnated fabric by drying such as by using a drying tower at ambient pressure and a temperature which partially crosslinks the binder resin. The product exiting the coating tower is a partially cured tack-free preform (B-stage preform). This partial curing is characterized by the binder matrix still being flowable during the subsequent application of heat and pressure to form the printed wiring board. Preferably such flowability is such that 30 to 40 wt % of the binder matrix flows outwardly from the extremity of the printed wiring board, whereupon this excess binder matrix is trimmed away. The preform sandwiched between plies of release paper can be wound on a wind-up roll and stored for later use.

In a second stage, the preform is heated to thermally induce a crosslinking reaction and to completely cure the composite structure. This second stage includes simultaneously adhering to each side of the preform a conductive layer of a thin film of copper metal having a basis weight of about 1 oz/ft$^2$ and typically formed by electrodeposition on the surfaces of the preform. The metal/preform laminate structure is subjected to a combination of an elevated pressure and temperature. Satisfactory resin crosslinking and metal adhesion is achieved by placing preform and copper film pieces into a full vacuum atmosphere and between press platens and heating from ambient room temperature to 175° C. at a rate of approximately 4 degrees per minute and holding at peak temperature for 30 minutes. The heated copper film/impregnated composite structure is compressed by platen pressure to approximately 100 pounds per square in. The laminated composite structure is cooled to room temperature. Subsequently, the platen pressure is decreased to contact pressure and the interior pressure of the equipment is increased to ambient pressure. The finished laminated composite structure is removed for use in subsequent manufacturing operations.

Thermoplastic resins can be used as the binder matrix in a similar manner as thermoset resins. The drying of the thermoplastic resin merely solidifies it to a tack free state. Just as subsequently heating the B-stage preform containing thermoset resin to cure the resin and adhere it to the conducting-layer(s), such subsequent heating causes the thermoplastic resin to adhere to the conducting layer(s).

The composite structure for printed wiring board, which includes the copper layer on each surface, after drying and heating (curing) preferably has a thickness of about 5 mils or less, more preferably less than 3 mils, and even more preferably less than 2 mils.

The fabric of this invention has improved dimensional stability when it contains yam of thermoplastic fluoropolymer that preferably has a modulus of at least 40 gpd, (preferably>50 gpd) a dimensional stability characterized by less than 2% shrinkage after heat treatment at 150° C., and hygroscopicity less than 0.1 wt % (moisture and solvent regain). An Example of fabric useful in this embodiment is as follows: plain weave fabric (80×80 ends/in$^2$) made from 100 denier yam. ETFE is the preferred fluoropolymer for use in the yarn, because of its greater strength and dimensional stability than other thermoplastic fluoropolymers. An example of ETFE yam is the yam prepared in Example 34.

Composite structure of the present invention just described for printed wiring boards can be used in the construction of a radome. A radome usually mounted on the nose of an airplane is a plastic housing sheltering radar equipment from high velocity air and moisture. The fabric used to reinforce the binder matrix for the printed wiring board application also reinforces the binder matrix formed into the radome shape. In the radome application, however, wherein rigidity and greater strength is required, the thickness of the composite structure may be greater, e.g. 5 to 10 mils per ply of fabric, and the fabric may be heavier. An example of a reinforcing fabric therein for this application is as follows: a 20×20 plain weave fabric made from 1000 denier yam. Instead of the yam being made entirely of highly fluorinated thermoplastic polymer, preferably ETFE, such yarn can be a composite of such polymer and other fiber, such as glass Alternatively, the fabric in the composite structure can be a composite of fluoropolymer yam and yam of other material, e.g. glass fiber (includes quartz fiber), obtained by e.g. alternating ends of these yams within the fabric. Such fabric can be made by weaving or knitting. These possibilities for the yam and the fabric used in the construction of a radome can also be used in the fabric/binder matrix composite structure used in making printed wiring boards. This fabric forms still another embodiment of the present invention.

Composite structures for making radomes can also be used in the construction of an antenna dome, which protects the communications antenna usually found mounted in the tail of aircraft. For both applications, materials that are tough, lightweight, and structurally stable are desired as well transparent to high frequency radio waves. The materials used in the construction of such domes preferably have a low dielectric constant and a low dielectric loss, which properties can be correlated to improved radar transparency. The fabric containing yam comprising thermoplastic fluoropolymer provides all these advantages.

When highly fluorinated thermoplastic polymer of this invention is used for construction of radar and antenna domes, an impregnated fluoropolymer fabric preform is made. Just as described above, such a preform may comprise single or multiple layers of fabric woven from melt-processible yam, impregnated with a thermoset resin solution and dried to a tack free preform. In constructing a radome, it is common to laminate several layers of preform around a nose-shaped mandrel, to overlay a honeycomb sheet of Nomex® aramid, and then to superimpose several more preform layers over the honeycomb structure to form a sandwich of the honeycomb sheet between layers of the preform. The entire structure is placed under vacuum and heated in an oven to form a dome-shaped housing of Nomex® aramid sandwiched between impregnated fabric containing yarn of highly fluorinated thermoplastic polymer. The preferred fluoropolymer yam is ETFE having a low dielectric constant and reduced moisture sensitivity. Structures that are lightweight with good machinability are produced in this manner.

An alternative form of construction which takes advantage of the strength of glass fabric, is to combine layers of fabric containing thermoplastic fluoropolymer yam, preferably ETFE, with layers of glass fabric in building up the preform. Substitution of even some of the layers of glass fabric which is presently the material commonly used in producing radomes, results in lighter weight structures and lower dielectric constant.

In still another embodiment of the present invention, the strength of glass fiber strand (including quartz fiber strand) is imparted to yarn comprising thermoplastic fluoropolymer by forming a composite yam of these materials. In one embodiment, a yam of staple fiber of thermoplastic fluoropolymer is formed around a core strand of glass fiber, i.e. to form core-spun yam. By way of example. The core strand is continuous filament glass fiber yam (45,000 yds/lb), and the staple fiber yam wrapping around the core strand comprises 1 to 2 in. long staple fibers constituting 50 wt % of the composite yam. In another embodiment, thermoplastic fluoropolymer yam is braided around a core strand of glass fiber such as just described. In both embodiments, the fluoropolymer yam is wrapped around the core strand. These embodiments of yam enable the yam containing thermoplastic fluoropolymers such as FEP and PFA which exhibit lower tenacity than ETFE yam to be strengthened sufficiently to provide the desired reinforcement of the composite structures.

Example 30

Another embodiment of the present invention is electrical cable comprising a conductive core member and an insulation sleeve containing yam comprising highly fluorinated thermoplastic polymer positioned around said conductive core member. Instead of the yam being a fabric, as in Example 29, the yam in this embodiment may be a braided structure in the sleeve shape.

In accordance with this embodiment, the thermoplastic fluoropolymer is advantageously used for electrical insulation or as part of the insulation system for the conductive core member because of the low dielectric constant and low dissipation factor of the polymer. As technology advances, more stringent requirements are being placed upon traditional wire and cable. In missile and aerospace applications, there is a desire for lighter weight cabling which correlates to improved aircraft performance and reduced operating costs. There is also a need for the wiring to meet stringent shielding specifications, in order to protect onboard electronics as aircraft and space vehicles fly through fields of radiation, magnetic, and electrical interference. An insulation sleeve formed from the thermoplastic fluoropolymer of this invention is strong, light weight, very flexible, moisture resistant in addition to the excellent electrical properties mentioned above.

An example of the electrical cable of the present invention is as follows: The electrically conductive core is composed of at least one metallic wire, usually of copper. The wire can be straight, twisted or braided as conventionally known or can be bare or individually insulated. Optionally the conductive core may be covered by one or more layers of other thin insulation. The insulation sleeve of this invention can be applied by wrapping fluoropolymer yam or fabric, preferably using ETFE fiber as the fluoropolymer, around the core member or braiding ETFE yam over the core member. Because of the high tenacity and flexibility of ETFE filaments, very thin filaments can be used, thus permitting a tightly woven yarn or braid.

To make this cable, all coverings of the electrically conductive core are stripped from a 30 foot section of a standard coaxial cable RG58 ANU cable. The RG58 A/U cable is made using 20 Gauge tinned copper conductive core, polyethylene insulation layer, tinned copper braid (95% coverage) shielding layer and a polyvinyl chloride jacket layer. ETFE yam is braided over the stripped portion of the conductor, using a tubular braid such that approximately at least 85% of the conductor is covered, preferably at least 90%, and more preferably at least 95%.

ETFE yams used in this example are prepared from Tefzel® ETFE fluoropolymer prepared according to Example 34, although other processes can be used which yield a high tenacity fiber.

Example 31

Another embodiment of the present invention is the use of fabric containing yam comprising ETFE, the fabric being combined with a support to maintain the desired disposition of the fabric for outdoor exposure. Whereas outdoor fabrics of materials, without fluoropolymer coating have a life of less than 10 years before failure, ETFE is not affected by outdoor exposure. The ETFE fiber of the yam can be continuous filament or staple fiber and the yam can be monofilament or multifilament. The yam preferably has a tenacity of at least about 2 g/den and more preferably, at least about 3 g/den, such as prepared in accordance with Example 34.

One aspect of this embodiment is architectural fabric such as roofing, including domes, which are supported by structure above or beneath the architectural fabric. The chemical inertness of the ETFE, e.g. inert to sunlight (UV) and its moisture resistance makes it ideal for architectural applications. Typically, architectural fabric is much heavier than fabrics having other uses. For example, apparel fabric generally weighs no more than 4 oz/yd$^2$, while architectural fabrics weigh at least 10 oz/yd , and usually at least 20 oz/yd$^2$. In the architectural fabric of the present invention, the yam will preferably have a tenacity of at least 3 g/den. Typical architectural fabrics prior to the present invention are composed of glass fabric coated with fluoropolymer to make the fabric water repellent. The architectural fabric of the present invention is water repellent by itself and much lighter in weight than glass-fabric-based roofing. Thus, substitution of the fabric containing yam comprising ETFE for some or all of the glass fabric provides lighter-weight roofing. An example of architectural fabric of the present invention is as follows: fabric of 3000 denier ETFE yam (40 den/filament), the fabric having a basis weight of 15 oz/yd 2. This fabric can be supported to form roofing by known means. For some roofing applications, the fabric need not be coated for imperviousness to water, that already being achieved by the fabric itself, thus reducing cost and contributing to the lightness-in-weight of the roofing. If desired, however, to obtain imperviousness to air, the fabric can be coated or impregnated with fluoropolymer. Another embodiment of architectural fabric is exterior shading positioned over windows to reduce sun glare Another aspect of this embodiment is as protective covers that are supported by a frame in such utilities as awnings, canopies, tents, vehicle convertible tops. An example of fabric useful in all of these utilities is as follows: fabric having a basis weight of 4 oz/yd$^2$ of a plain weave, balanced construction of 1000 denier ETFE yam.

Another embodiment of protective cover is that which is draped over an object to keep the object dry. Examples of such protective covers are vehicle covers, such as for boats, trailers, automobiles. An example of fabric useful for these utilities is as follows: fabric having a basis weight of 4 oz/yd$^2$, plain weave, balanced construction, made of 1000 denier ETFE yarn.

Another example of this embodiment is as furniture covers, upholstery covering or slip covering for either indoor or outdoor use. The chemical resistance of the ETFE fiber resists discoloration upon exposure to the weather, and the fabric is easy to clean and fast drying. An example of fabric suitable for this use is as follows: fabric having a basis weight of 10 oz/yd$^2$ of a plain weave, balanced construction, made of 1000 denier ETFE yam, 20 den/filament In each of these embodiments, the fabric is combined with support structure to maintain the desired disposition of the fabric. In the case of architectural fabric, awnings, canopies, tents and convertible tops, the support can be a frame conventionally used in these applications. In the case of draped covers, the support structure is the inanimate object being protected. The same is true for the furniture covers.

Another embodiment of the present invention is luggage exteriors of fabric described above. The luggage exterior may have an inside frame support or be soft-sided, i.e. not have an inside support. Such fabric will generally have a weight of 5 oz/yd$^2$ to 15 oz/yd$^2$. The ETFE fiber in the fabric provides a tough, durable, abrasion resistant luggage exterior, in which stains usually encountered in use can easily be removed. An example of such fabric is as follows: fabric having a basis weight of 8 oz/yd$^2$ woven from 400 denier ETFE yam, 40 denier/filament.

Another example of this embodiment is sailcloth, which is supported by conventional mast and rigging structure. The weave of the fabric used in this embodiment is tight enough to form a barrier to passage of air through the fabric. Nevertheless, the fabric has the wind-driven low elongation desired for sailcloth, with the yarn from which the sailcloth fabric is made being characterized by a modulus of at least 40 g/den. Such fabric is durable, being resistant to degradation by exposure to the sun, air and the sea. An example of such fabric is as follows: fabric having a basis weight of 4 oz/yd$^2$ made from 400 denier ETFE yam, 15 denier/filament, the fabric having a break strength of at least 75 lb/in.

Still another example of advantageous use for fabric which contains ETFE yam is for use as flags and banners for outdoor exposure, typically made using 70–200 denier ETFE yam.

Example 32

Suture yarn as exemplified in Example 27 can be woven, knitted into a fabric or braided for use as a medical textile such as hernia patch or vascular graft. ETFE possesses superior biocompatibility and its low friction characteristics and strength make it especially suitable for use in this application.

In one embodiment, ETFE yam such as made in accordance with the present invention can be formed into patches for use in direct contact with the skin such that the patch is either adhered to the skin or to a surface that comes in contact with the skin (such as a sock). The patch of this invention reduces friction between a portion of skin of a person or animal covered by the patch and an object that is pressing on that area of the body and has long life in this application because of no adverse interactions with the body The patch retains its low coefficient of friction in both wet and dry conditions. reducing the abrading effect of objects that rub against the skin's surface, such as a shoe. Such medical patches are normally no more than 40 in$^2$ in size and are bounded by an unraveling selvage of ETFE fiber. An alternative, application is the use of an ETFE patch as a protective layer in the socket of a prosthetic limb. Such patches reduce the effect of shear thus avoiding the formation of sores and blisters in stressed, load bearing areas. By example, a suture yam can be made in the manner as described in Example 34 with a dpf of 13(or 13–40 dpf) and a tenacity of 3.45 g/den. The suture yam can be made for example from a single end of yarn or multiple plies thereof, usually 4 plies to give a total denier of 50 to 2000. Instead of being made from multiple filaments of ETFE, the yam can be monofilament. An example of a medical patch is as follows: knitted fabric of 5 to 10 mils diameter ETFE monofilament forming mesh openings of about 1/16 in.

In another embodiment, a woven tube of ETFE yam of the invention can be used as an implantable intraluminal prosthesis, particularly a vascular graft in the replacement or repair of a blood vessel. ETFE exhibits excellent biocompatibility and low thrombogenicity. Once implanted, the microporous structure of the tube will allow for natural tissue ingrowth, promoting long term healing. An example of fabric for this utility is a braided tube of 4 plies of ETFE yam having a denier of 50–400. The tube will have coverage of at least 90% and typically will have an internal diameter of 1/8 in. to 1 in.

Another embodiment of the invention is a process for decontaminating a fabric, e.g. destroying microbes and endospores, said fabric containing yam comprising highly fluorinated thermoplastic polymer, said sterilizing comprising exposing the fabric to a treatment selected from the group consisting of boiling in water, steaming, optionally in an autoclave, bleaching, and chemical agent, such as ethylene oxide, optionally mixed with hydrochlorofluorocarbon cleaning agent or carbon dioxide, hydrogen peroxide optionally in the vapor state, plasma, and peracetic acid, said fabric not being harmed by any of such treatments. Fibers of ETFE and other of highly fluorinated thermoplastic polymer of this invention have the ability to resist the adverse affects of high temperatures and harsh chemicals that permit the fabrication of medical garments and cloths (such as hospital sheets, pillow covers, and bed mats etc.) that can be subject to sterilization treatments. An Example of such fabric is as follows: fabric made by plain weave, balanced construction, having a basis weight of 3 oz/yd$^2$, of 150 denier ETFE yam.

Example 33

Another embodiment of the present invention is flame resistant, self-extinguishing fabric containing yarn comprising highly fluorinated thermoplastic polymer that has a limiting oxygen index of at least 30 (31 actual for ETFE-ASTM D2863), a UL 94 rating of V—O, and has an average loss weight of less than 40% according to vertical flame test (method 1) of NFPA 701.

Important to furnishing many public areas is the ability of a fabric to resist flame propagation. This flame resistance is of particular concern to aircraft, mass transit vehicles such as buses and trains, schools, hospitals, nursing homes, theaters and hotels. Fabric made from yams of this invention can be used in making carpeting, wall coverings, seat upholstery, window coverings such as curtains, shades and blinds, hospital garments, sheets, pillow covers, mattress covers and the like, conferring to these furnishings the ability to resist the spread of flame and allowing time for the egress of individuals caught in a burning building or vehicle.

A preferred embodiment is a flame resistant, self-extinguishing fabric containing yam comprising ethylene-tetrafluoroethylene copolymer. By way of example, yam of ETFE can be made in the manner as described in Example 34 having a tenacity of 3.45 g/den and denier of 400 and woven into fabric, using a plain weave, balanced construction, the fabric having a basis weight of 3.5 oz/yd$^2$. Other methods can be used to make the yam, which yields the tenacity desired for the particular application.

The fabric is tested according to ASTM D2863 and has a limiting oxygen index of 31 (volume % oxygen required for combustion). This test method is a procedure for measuring the minimum concentration of oxygen that will just support flaming combustion in a flowing mixture of oxygen and nitrogen of a material initially at 23+/−2° C. under the conditions specified in the test method.

The fabric is further tested for burning behavior according to Underwriters Laboratory procedure UL 94. Results are classified NC (not classified) when failing or V-0, V-1, or V-2 depending on various parameters obtained in the test, V-0 being best while V-2 is worst. The ETFE fabric of this invention has a rating of V-0.

The fabric of ETFE is further subjected to vertical flame test NFPA 701. The average weight loss is 16% and the fabric is self-extinguishing. Similar results are obtained when the fabric is made of yam comprising other highly fluorinated, especially perfluorinated, thermoplastic polymers, such as PFA and FEP.

In accordance with the specifications of Test Method 1 of NFPA 701, a weighted specimen of textile is suspended vertically and a specified gas flame is applied to the specimen for 45 seconds and then withdrawn. The specimen is allowed to bum until the flame self-extinguishes and there is no further specimen damage. The specimen is weighed and the percent weight loss is determined and used as a measure of total flame propagation and specimen change.

In another embodiment, the invention includes a process for retarding the spread of flames (suppressing fire) in an enclosed area by furnishing said area with articles comprising fabrics containing yam comprising highly fluorinated thermoplastic polymer, wherein said fabrics have an average weight loss of less than 40% according to vertical flame test NFPA 701. The articles being furnished may include, carpeting, wall coverings, dividers, seat covers, hospital garments, sheets, pillow covers, mattress covers, window coverings such as curtains, blinds and shades, and the like. Especially preferred is the process wherein the fabric contains yam comprising ETFE and the average weight loss is less than 25%.

Example 34

The yam used in this experiment is Tefzel® ETFE fluoropolymer which is a terpolymer of ethylene, tetrafluoroethylene, and less than 5 mole % perfluoroalkyl ethylene termonomer, having a melting temperature (peak) of 258° C. and melt flow rate of 29.6 g/10 min, both as determined in accordance with ASTM 3159, using a 5 kg weight for the MFR determination.

The lubricant used in this experiment is as follows: 88.9 wt % Clariant Afilan® PP polyol polyester, 5 wt % Uniqema® G-1144 polyol ethoxylated capped ester oil emulsifier, 0.67 wt % Cytek Aerosol® TO dioctyl sulfosuccinate wetting agent (75 wt % aqueous solution), 5 wt % Cognis Emersol 871 fatty acid surfactant, 0.26 wt % Uniroyal Naugard® PHR phosphite antioxidant, 0.67 wt % sodium hydroxide (45 wt % aqueous solution) stabilizer for the fatty acid, and 0.04 wt % Dow Coming polydimethylsiloxane (process aid—minimizes deposits of the lubricant on the hot rolls).

The fluoropolymer and the lubricant have surface tensions of 25 dynes/cm and 23.5 dynes/cm respectively, at ambient temperature, determined in accordance with the procedures described above.

The melt spinning of the fluoropolymer is carried out using an equipment arrangement as shown in FIG. 9, except that the kiss roll 112 and the guides 111 are not present, and the lubricant is applied using an applicator guide positioned beneath the annealer 110, upstream from the change in direction guide. The application guide is similar to a Luro-Jet® applicator guide, having a V-shaped slot which brings the array of extruded filaments together within the slot and which includes an applicator at the base of the V-shape, which, in turn, includes an orifice through which the lubricant is pumped (metered) onto the yarn as it passes across the applicator.

The extruder is a 1.5 in. diameter Hastelloy C-276 single screw extruder connected to a gear pump, which in turn is connected through an adapter to the spinneret assembly which includes a screen pack to filter the molten polymer. The spinneret assembly is the assembly 70 of FIG. 8 and includes a transfer line and spinneret faceplate depicted as elements 78 and 75, respectively, in FIG. 8. The spinneret faceplate has 30 holes arranged in a circle having a two-inch diameter, each hole (extrusion die orifice) has a diameter of 30 mils and a length of 90 mils. The annealer is that of Example 12 and FIGS. 10A and 10B.

Operating temperatures are as follows:

Extruder: 250° C., 265° C., 270° C. at extruder zones—Feed, #1 and #2 respectively Transfer line: 317° C.

Spinneret faceplate: 350° C.,

Annealer: 204° C., 210° C., and 158° C. at the #1, #2, and #3 positions, respectively.

The fluoropolymer throughput (fluoropolymer exiting the spinneret) is set by the gear pump to be the maximum, i.e. just short of causing melt fracture in the extruded filaments, this maximum being 50.5 g/min (6.7 lb/hr). The resultant yam solidifies at a distance from the spinneret that is greater than 50× the diameter of the extrusion orifice. The lubricant described above is applied to the yam just below the annealer and the feed rolls are at a temperature of approximately 180° C. and surface speed of 309 m/min. The draw rolls are heated at 150° C. and rotate at a surface speed of 1240 m/min to provide a draw ratio of 4.01. The yarn is wound onto a bobbin using a Leesona winder. The resultant yarn has the following properties: tenacity-3.45 g/den, elongation 7.7%, tensile modulus-55 g/den. When the draw ratio is decreased to 3.69 by reducing the surface speed of the draw rolls to 1140 m/min, the following yam properties are obtained: tenacity-3.14 g/den, elongation-9.4%, modulus 51 g/den. The yarn denier increases from 374 to 407.

When the feed roll temperature is varied as follows: approximately 115° C., 135° C., 160° C., and 180° C. and the draw ratio is set by the surface speed of the draw rolls to be the maximum before filament breakage occurs, as follows: 3.60, 3.80, 3.80, and 4.00, respectively, the tenacity of the yam generally increased, as follows: 3.27 g/den, 3.42 g/den, 3.41 g/den, and 3.48 g/den. Thus the highest tenacity yam is obtained at the highest feed roll temperature.

The lubricant is effective enough that the spinneret temperature can be increased to 365° C. (Transfer line—326° C.) with a feed roll being at a temperature of approximately 195° C. and surface speed of 423 m/min (all other parameters as stated above) to enable the fluoropolymer throughput to be increased to 68.8 g/min (9.1 lb/hr), providing a draw ratio of 4.00, to obtain a 358 denier yam having the following properties: tenacity-3.31 g/den, elongation-7.8%, and tensile modulus of 53 g/den.

The coefficients of variation of the denier of the yarns prepared as described above and as determined using the cut and weigh method are less than 2%.

When the spinneret temperature is reduced to 335° C., the fluoropolymer throughput (same fluoropolymer as above) of the spinneret has to be reduced substantially to avoid melt fracture, namely to just 35.5 g/min (4.7 lb/hr). Thus, carrying out the melt spinning at just 15° C. higher than 335° C. provided a production increase of 42% and the further increase to 365° C., provided a production increase of 94%.

Yams of this invention are subjected to wide angle X-ray scattering (WAXS) analysis. ETFE yams produced at spinneret temperatures of 350° C. and 365° C. under the conditions as described above with variations listed in Table 5. The orientation angle (OA) and the Apparent Crystallite Size (ACS) are determined.

TABLE 5

| Sam-ple | Draw mpm | Feed ° C. | Draw Ratio | Den | Ten gpd | ACS Å | OA° | Ratio OA/ACS |
|---|---|---|---|---|---|---|---|---|
| 34-1 | 1236 | 180 | 4.00 | 374 | 3.45 | 69.5 | 15.7 | 0.23 |
| 34-2 | 1140 | 180 | 3.69 | 407 | 3.14 | 67.3 | 16.7 | 0.25 |
| 34-3 | 1042 | 180 | 3.37 | 443 | 2.74 | 63.4 | 20.2 | 0.33 |
| 34-4 | 942 | 180 | 3.05 | 490 | 2.35 | 59.8 | 21.2 | 0.36 |
| 34-5 | 843 | 180 | 2.73 | 547 | 1.97 | 56.7 | 24.1 | 0.44 |
| 34-6 | 1607 | 180 | 3.80 | 390 | 3.17 | 67.4 | 18.1 | 0.28 |
| 34-7 | 1692 | 196 | 4.00 | 358 | 3.31 | 70.9 | 16.0 | 0.23 |

Preferred ETFE yams of this invention have an orientation angle of less than about 19° which is an indication of yam tenacity of greater than about 3.0 g/den. All of the yams represented in the Table have a tensile quality of at least 9. Thus the yams having an OA of less than about 19° represent an even more preferred yarn than indicated by tensile quality.

The ETFE fibers being examined contain a mesophase structure. A polymeric mesophase is a structure of seemingly one dimensional order where the chains have a high degree of axial orientation but little lateral correlation, other than similar separation distances between polymer chains. A mesophase is distinguished from a crystal in that a crystal is highly ordered on an atomic scale in all three directions.

Mechanistically, molecular orientation and resulting mesophase domains are produced mainly in the draw step on the spinning machine. High draw ratio, which leads to high tenacity, increases the width of the oriented regions or domains ("apparent crystallite size", ACS) and also improves the orientation of the chains relative to the fiber axis in a way that narrows the orientation angle.

This mesophase diffraction pattern (WAXS) is characterized by a single strong equatorial peak and continuous diffuse scattering on the higher layer lines. The position of the equatorial peak is characteristic of the average chain separation distance. The width of the equatorial peak (ACS) contains information about the average domain size (normal to the fiber axis). The azimuthal breadth of the equatorial reflection contains information about the orientation of the chains in the mesophase (full width at half height).

The orientation angle (OA) may be measured (in fibers) by the following method:

A bundle of filaments about 0.5 mm in diameter is wrapped on a sample holder with care to keep the filaments essentially parallel. The filaments in the filled sample holder are exposed to an X-ray beam produced by a Philips X-ray generator (Model 12045B) operated at 40 kV and 40 mA using a copper long fine-focus diffraction tube (Model PW 2273/20) and a nickel beta-filter.

The diffraction pattern from the sample filaments is recorded on Kodak Storage Phosphor Screen in a Warhus vacuum pinhole camera. Collimators in the camera are 0.64 mm in diameter. Exposure times are chosen to insure that the diffraction patterns are recorded in the linear response region of the storage screen. The storage screen is read using a Molecular Dynamics Phosphorlmager SI. and a TIFF file containing the diffraction pattern image is produced. After the center of the diffraction pattern is located, a 360° azimuthal scan, through the strong equatorial reflections is extracted. The Orientation Angle (OA) is the arc length in degrees at the half-maximum density (angle subtending points of 50 percent of maximum density) of the equatorial peaks, corrected for background.

The apparent crystallite size (ACS) is measured by the following procedure:

Apparent Crystallite Size is derived from X-ray diffraction scans, obtained with an X-ray diffractometer (Philips Electronic Instruments; cat. no. PW1075/00) in reflection mode, using a diffracted-beam monochromator and a scintillation detector. Intensity data are measured with a rate meter and recorded by a computerized data collection and reduction system. Diffraction scans are obtained using the instrumental settings:

Scanning Speed: 0.3° 2θ per minute

Stepping Increment: 0.05° 2θ

Scan Range: 6–36° 2θ

Pulse Height Analyzer: Differential

Diffraction data are processed by a computer program that smoothes the data, determines the baseline, and measures the peak location and height.

The diffraction pattern of fibers from this invention is characterized by a prominent equatorial X-ray reflection located at approximately 19.0° 2θ. Apparent Crystallite Size is calculated from the measurement of the peak width at half height.

In this measurement, correction is made only for instrumental broadening; all other broadening effects are assumed to be a result of crystallite size. If B is the measured line width of the sample, the corrected line width β is $$\beta=(B^2-b^2)^{1/2}$$

wherein 'b' is the instrumental broadening constant. 'b' nis determined by measuring the line width of the peak located at approximately 28.5° 2θ in the diffraction pattern of a silicon crystal powder sample.

The Apparent Crystallite Size is given by $$ACS = \frac{K\lambda}{\beta\cos\theta}$$

wherein K is taken as one (unity), λ is the X-ray wavelength (here 1.5418 Å), β is the corrected line breadth in radians and θ is half the Bragg angle (half of the 2θ value of the selected peak, as obtained from the diffraction pattern).

Both apparent crystal size (ACS) and orientation angle (OA) are described in detail in "X-Ray Diffraction Methods in Polymer Science", Leroy E. Alexander, Robert E. Krieger Publishing Company, Huntington, N.Y. In the 1979 edition, ACS determination is discussed in Chapter 7 (p 423 ff) and orientation angle in Chapter 4, pp 262 to 267.

What is claimed is:

1. Oriented filament of highly fluorinated thermoplastic polymer wherein the birefringence of the filament at the surface of the filament is less than that of the core of the filament.

2. The oriented filament of claim 1 wherein the orientation of the filament is greater in the core of the filament than at the surface of the filament.

3. The oriented filament of claims 1 and 2 in multifilament yarn.

4. The filament of claims 1 and 3 having a tenacity of at least 2 g/d.

5. The filament of claims and 1 and 3 having an elongation of at least 15%.

6. The filament of claims 1 and 2 wherein said polymer is ethylene/tetrafluoroethylene copolymer.

7. The filament of claim 6 wherein said copolymer contains about 0.1 to about 10 mole % of at least one copolymerizable vinyl monomer that provides a side chain containing at least 2 carbon atoms.

8. Sewing thread containing the filament of claims 1 and 2.

9. Dental floss containing the filament of claims 1 and 2.

10. Fishing line containing the filament of claims 1 and 2.

11. The filament of claims 1 and 2 chopped up into staple fiber.

12. Yarn containing the staple fiber of claim 11.

13. Felt containing the staple fiber claim 11.

14. The filament of claims 1 and 2 containing colorant.

* * * * *